United States Patent [19]

Huffman

[11] 3,955,750

[45] May 11, 1976

[54] MULTI-PANEL ENVELOPE FORM

[76] Inventor: Harold W. Huffman, 2100 John Gray Road, Fairfield, Ohio 45014

[22] Filed: May 13, 1974

[21] Appl. No.: 469,672

[52] U.S. Cl. ..... 229/69; 229/85; 229/92.1

[51] Int. Cl.[2] ..... B65D 27/10

[58] Field of Search ..... 229/69, 85, 92.1, 92.3, 229/92.7

[56] References Cited

UNITED STATES PATENTS

| | | | |
|---|---|---|---|
| 3,104,799 | 9/1963 | Steidinger | 229/69 |
| 3,197,121 | 7/1965 | Hayes, Jr. | 229/92.1 |
| 3,228,586 | 1/1966 | Hayes, Jr. | 229/69 X |
| 3,319,871 | 5/1967 | Hayes, Jr. | 229/69 |
| 3,337,120 | 8/1967 | Steidinger | 229/85 |
| 3,482,780 | 12/1969 | Johnsen | 229/69 |
| 3,558,041 | 1/1971 | Buescher | 229/85 |
| 3,606,138 | 9/1971 | Allison | 229/85 |
| 3,837,565 | 9/1974 | Johnsen | 229/85 |

*Primary Examiner*—William Price
*Assistant Examiner*—Stephen P. Garbe
*Attorney, Agent, or Firm*—J. Warren Kinney, Jr.

[57] ABSTRACT

The single-ply, multi-panel envelope form comprises a pair of coplanar, envelope-defining panels disposed in end-to-end, spaced relationship and at least one intermediate panel disposed between and end-connected relationship with said envelope-defining panels wherein the opposite side edges of each intermediate panel are disposed inwardly of the corresponding side edges of the envelope-defining panels. The side edges of the envelope-defining panels of each form are disposed in contacting, sealed relationship when the panels of each form are zig-zag folded into envelope-defining relationship permitting removal of the intermediate panel from the interior of the envelope through access means provided in one marginal edge thereof.

The forms of the present invention are readily produced in an end-to-end connected series from a continuously advancing web of sheet material which is transversely subdivided into a plurality of end-to-end interconnected forms, each of which are adapted to be sequentially zig-zag folded into sealed, envelope-defining relationship, and thereafter severed from the series as individual forms. A stuffer-insert such as a circular or the like may be inserted in the interior of the envelope prior to sealing thereof.

12 Claims, 64 Drawing Figures

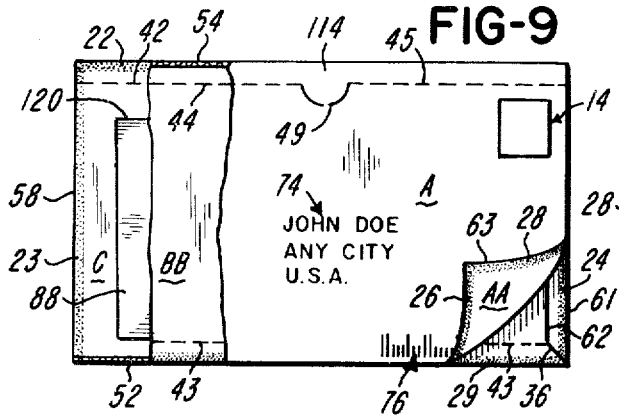
FIG-9
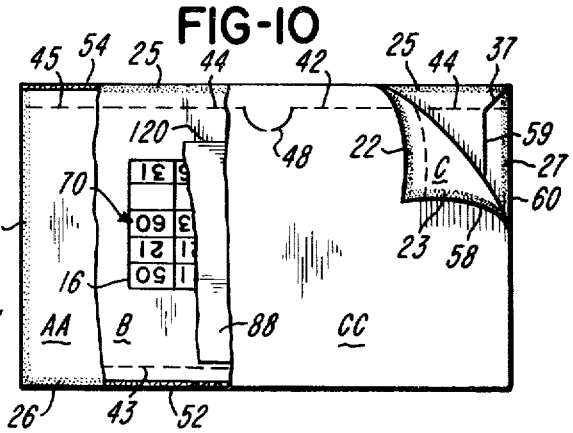
FIG-10
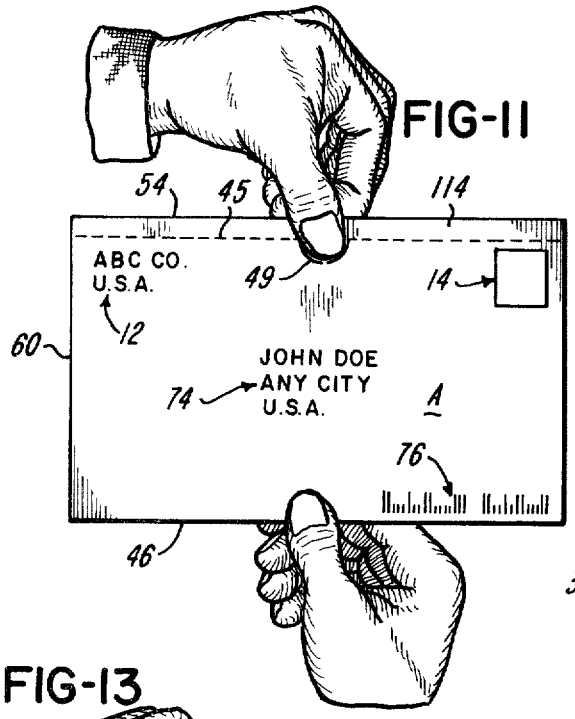
FIG-11
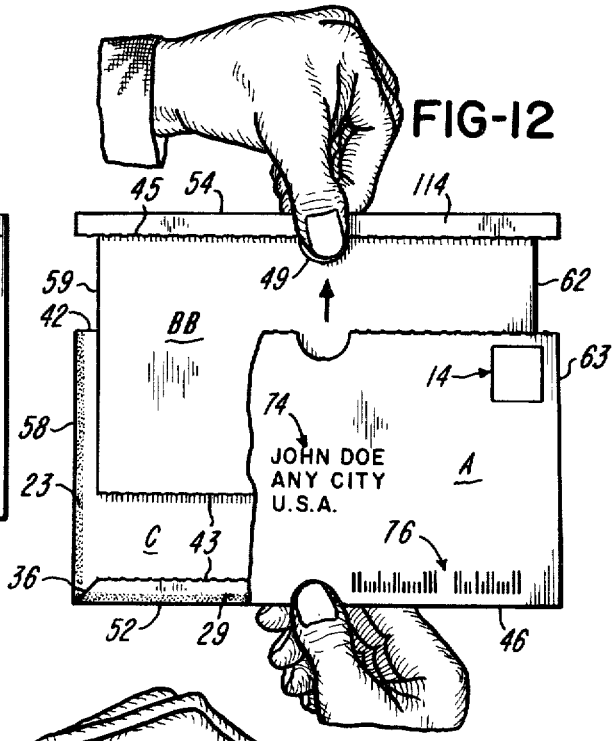
FIG-12
FIG-13
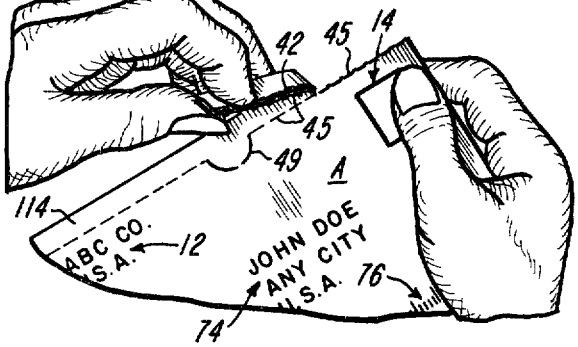
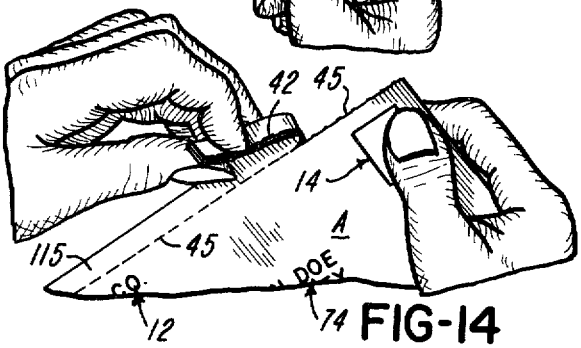
FIG-14
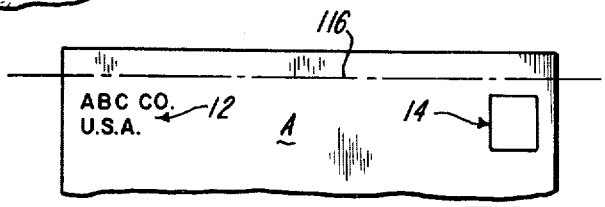
FIG-15

FIG-26
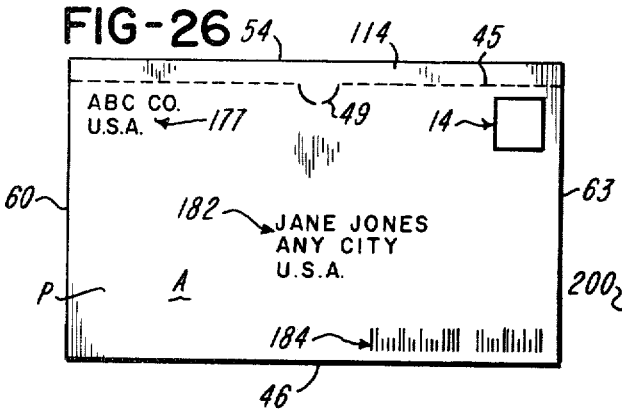
FIG-27
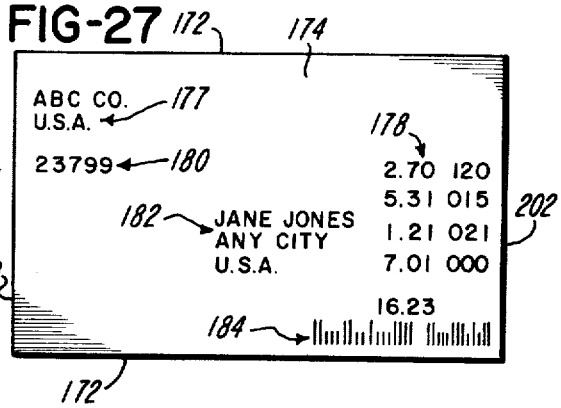
FIG-28
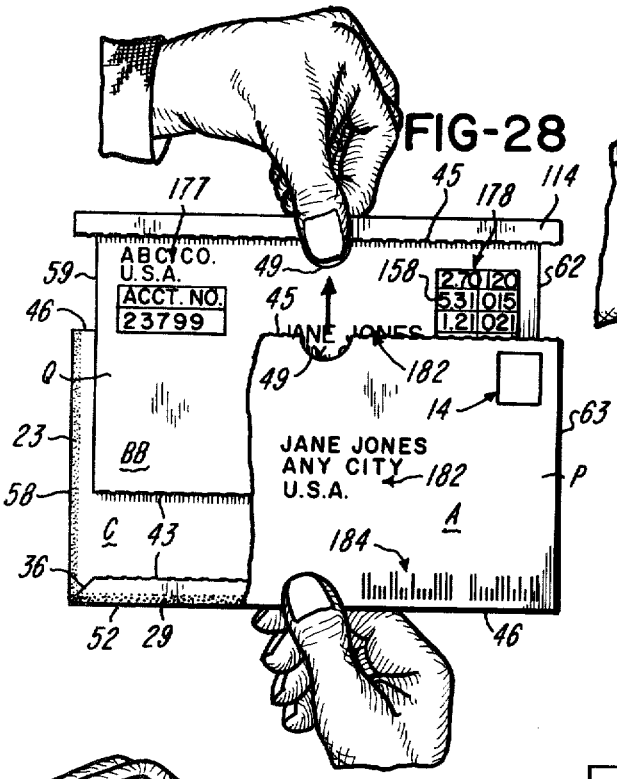
FIG-29
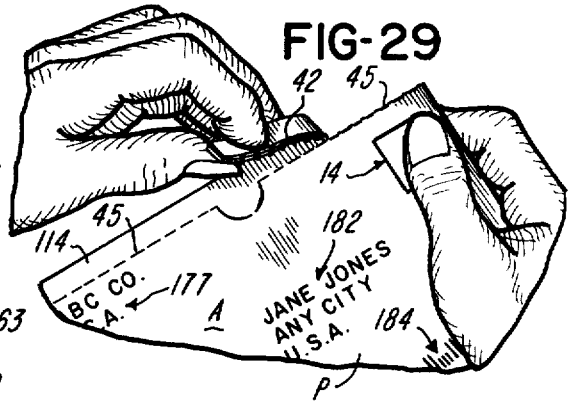
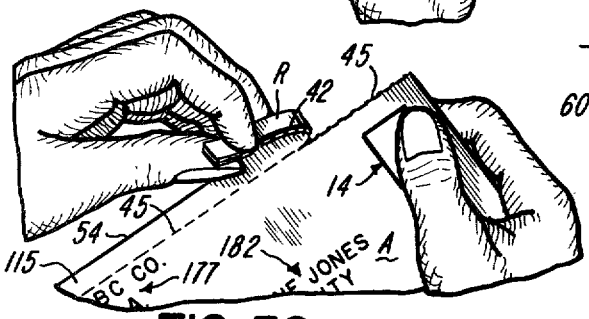
FIG-30
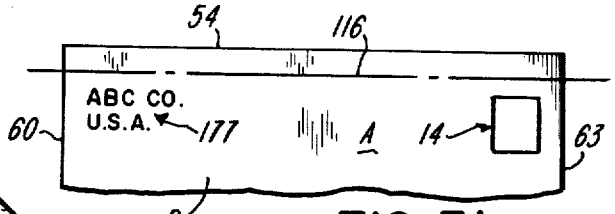
FIG-31

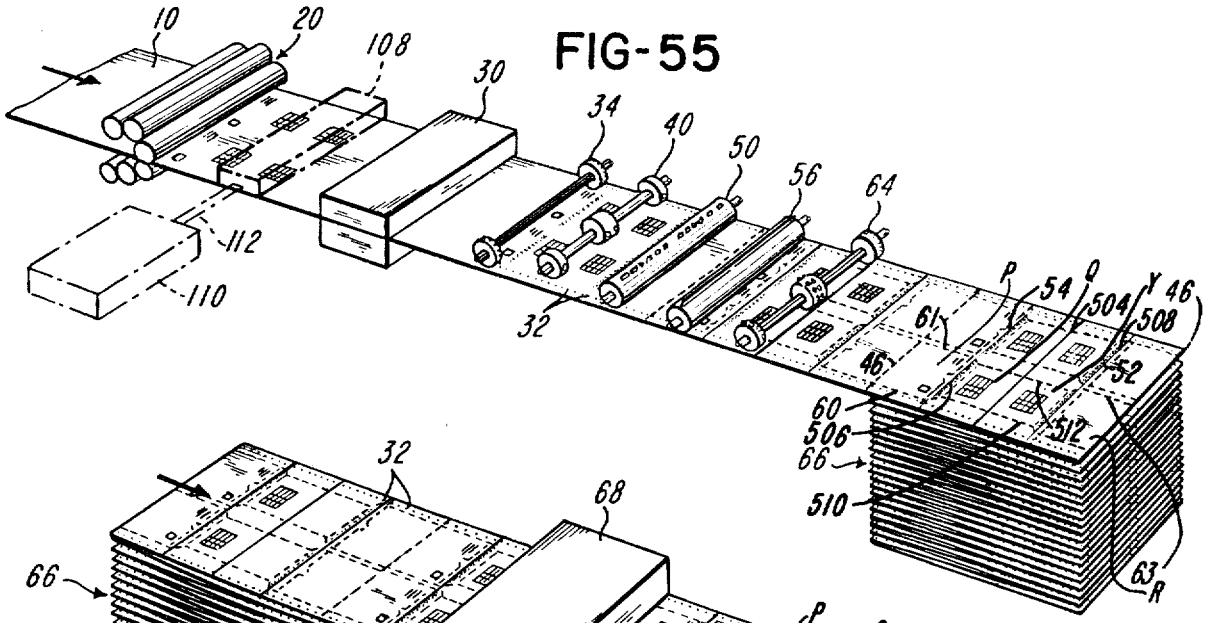
FIG-55
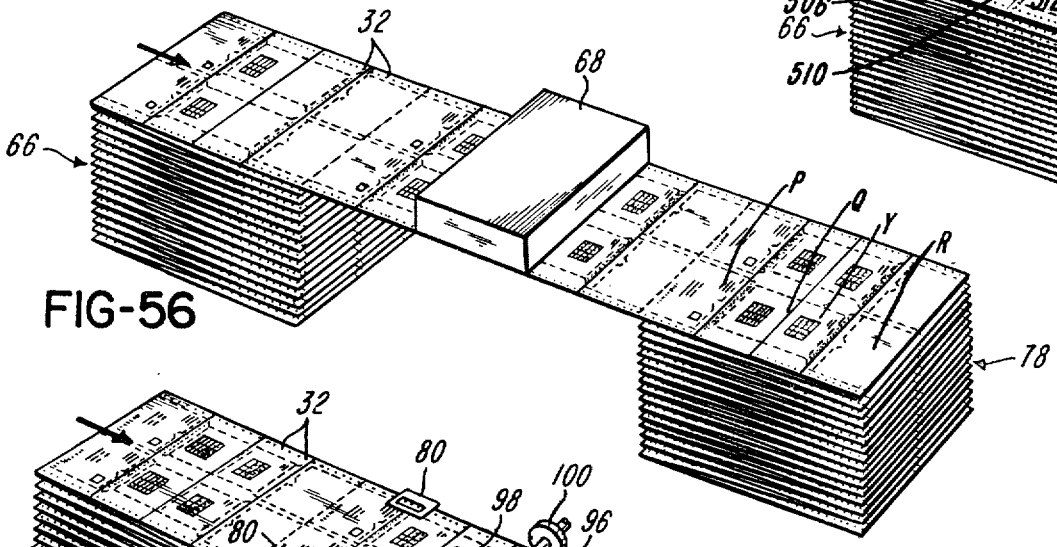
FIG-56
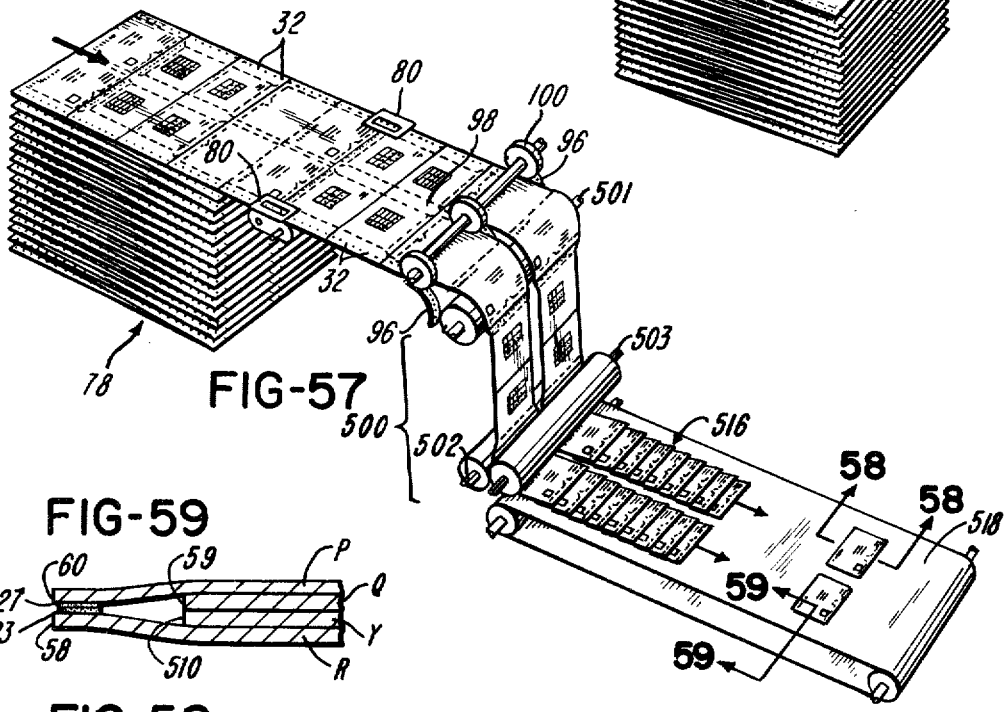
FIG-57
FIG-59
FIG-58
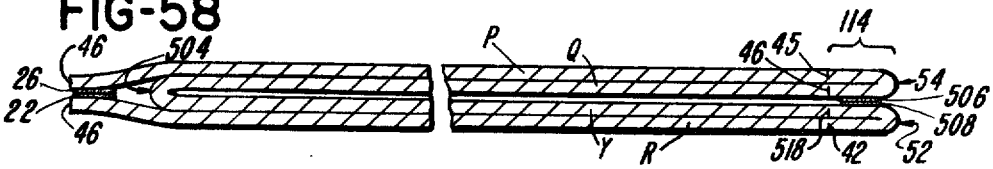

MULTI-PANEL ENVELOPE FORM

CROSS REFERENCE TO RELATED APPLICATION

The present application is related to my co-pending application entitled: "Method of Producing Multi-Panel Mailing Envelope Forms in Side-by-side Interconnected Series," application Ser. No. 469,673, now U.S. Pat. No. 3,902,655, filed on even date herewith, in which I have disclosed the methods for producing single-ply, multi-panel envelope forms in a side-by-side interconnected series from a continuously advancing web of sheet material, wherein the resulting forms and envelopes are similar, if not identical, to those of the present invention. My co-pending application is specifically limited and directed to the methods therein disclosed, wherein a continuously advancing, endless web of sheet material is transversely subdivided into a plurality of side-by-side interconnected forms, each of which is adapted to be thereafter continuously fan folded into sealed, envelope-defining relationship.

The methods of the present invention are readily distinguishable therefrom, in that a continuously advancing, endless web of sheet material is transversely subdivided into a plurality of end-to-end interconnected forms which are sequentially zig-zag folded into sealed, envelope-defining relationship.

While the resulting forms and envelopes of my co-pending application are similar in detail to those disclosed in the present invention, the methods thereof are substantially different. The present invention is directed to both the forms and the methods disclosed, whereas my co-pending application is specifically directed and limited to the particular methods disclosed therein.

BACKGROUND OF THE INVENTION

1. Field of the Invention

The present invention is directed to mailing envelope forms per se, to methods for producing the forms, and to methods for producing sealed envelopes per se from said forms. The panels of the form are disposed such that intermediate panels within the interior of the envelope may be removed therefrom through access means provided in one marginal edge thereof. The methods of the present invention provide for the insertion of stuffer-inserts such as circulars or the like into the interior of the envelope prior to sealing thereof. In one form of the invention an adjacent pair of intermediate panels define the front and back panels of an integral return envelope. In another form of the invention of a plurality of end-connected intermediate panels define an interior sheet having one dimension which is larger than the corresponding dimension of the resulting sealed envelope.

2. Description of the Prior Art

A number of patents have issued which are directed to mailing envelope assemblies, the most relevant being the Steidinger U.S. Pat. Nos. 3,104,799; 3,337,120; and 3,339,827.

U.S. Pat. No. 3,104,799 discloses an envelope assembly generated from a plurality of separate, independent, continuous webs which are collated with one another to form front, back and interior plies of an envelope and, where desired one or more record sheets. In the embodiment of FIGS. 7 and 8 thereof, a return envelope is incorporated in the envelope assembly. This, too, is generated from separate, independent webs which are disposed in overlying relationship with the various plies of the assembly. The envelope assembly of this patent precludes the addition of original indicia to the interior plies once the various plies have been collated to form a complete envelope assembly and, therefore, imprint printing techniques or preprinting is required. Further, the envelope assembly of this patent does not provide for the addition of insert material as that term is used herein, i.e., an insert which is not part of the actual assembly or form but one which is selectively and optionally added thereto, such as a circular or the like, which is placed within the existing leaves, plies or panels of the assembly.

U.S. Pat. No. 3,337,120 discloses an envelope assembly which comprises separate, independent plies of sheet material disposed in overlying registry. While this patent discloses a method for folding over-size interior plies and housing same within the envelope, it does not disclose an envelope wherein the over-size material is integral with and, prior to folding, coplanar with the envelope-defining panels. Again, once the various plies are collated with one another to define the envelope assembly, it is not thereafter possible to add original indicia to any of the interior plies, and no provision is made for the addition of insert material as that term is used herein.

U.S. Pat. No. 3,339,827 discloses an envelope assembly comprising a plurality of separate, independent plies which are disposed in overlying registry to define the front, back and interior plies of an envelope. One embodiment thereof (FIG. 11) discloses an envelope wherein the front and back plies or panels are generated from a single sheet of material which is adapted to be folded into envelope-defining relationship. However, as there illustrated, the interior sheets comprise separate, independent sheets or webs of material collated with the front and back panels of the envelope. Again, no provision is made for the insertion of insert material as that term is used herein.

The Van Malderghem U.S. Pat. No. 3,554,438 is also of significance with respect to the present invention, in that it discloses an envelope assembly comprising a plurality of separate, independent plies collated with one another to form the front, back and interior plies of an envelope. Access to the interior of the envelope and removal of the interior plies thereof is provided by means in one marginal edge of the envelope. As in each of the previously described prior art patents, no provision is made for the addition of insert material, as that term is used herein.

Other prior art envelope assemblies comprising a plurality of separate, independent plies which are collated with one another to define the front, back and interior plies of an envelope are disclosed in U.S. Pat. Nos. 3,312,385; 3,441,699; and 3,608,816, however, none of these later patents are as relevant as those already described.

The Johnsen U.S. Pat. No. 3,482,780 and the Wiessner U.S. Pat. No. 3,882,618 each disclose an envelope form or assembly wherein each of the various panels thereof are generated from a single sheet of paper which is adapted to be folded into sealed, envelope-defining relationship. Johnsen is limited to a two-panel envelope wherein the panels thereof are presented in a manner precluding single pass printing of the resulting interior and exterior surfaces of the envelope. Wiessner discloses a three-panel assembly wherein the intermediate panel defines the back of both send and return envelopes. Again, the panels of the form are presented in a manner that precludes single pass printing of the resulting exterior and interior surfaces of the envelope. Further, when folded, the front panel of the send envelope is actually secured to the front panel of the return envelope and must thereafter be removed therefrom, precluding a permanent sealing relationship therebetween. Neither of these patents disclose methods which provide for the addition of insert material to the interior of the envelope prior to sealing thereof.

SUMMARY OF THE INVENTION

The present invention differs significantly from each of the prior art methods and forms in that the forms are produced from a single web or sheet of material, wherein the panels thereof are disposed in interconnected, coplanar relationship, thereby permitting single pass printing of both interior and exterior surfaces of the resulting envelope structure. The invention comprehends a web of paper which is transversely zig-zag folded into sealed envelope-defining relationship containing at least one interior panel wherein the web is subdivided into a plurality of end-to-end connected forms, each of which comprises a pair of coplanar, envelope-defining panels disposed in end-to-end, spaced relationship with at least one intermediate panel disposed between and in end-connected relationship with said envelope-defining panels.

Means are provided for sealing the envelope-defining panels in registered, housing relationship with respect to the intermediate panel, wherein each intermediate panel includes side edges which are disposed inwardly of the corresponding side edges of the envelope-defining panels, permitting a contacting and sealing relationship between said corresponding side edges while providing an intermediate panel having side edges which are inward from and free of connection with said sealed edges. The intermediate panel may be readily removed from the interior of the resulting sealed envelope through access means provided in one marginal edge thereof.

Unlike the prior art embodiments, the methods of the present invention provide for insertion of insert material, such as circulars or the like, in the interior of the envelope prior to the sealing thereof. Thus, a basic or stock form may be used wherein the inserts may be selectively and optionally added without alteration thereof.

In one form, the invention includes an adjacent pair of intermediate panels which define the front and back panels of the return envelope. In another form, the invention includes a plurality of intermediate, end-to-end connected panels which collectively constitute an interior sheet having one dimension larger than the corresponding dimension of the resulting envelope.

A modification of the methods of the present invention provides for a series of end-to-end interconnected forms which are adapted for use in conjunction with imprint printing techniques, where such are desired.

It is, therefore, a primary object of the present invention to provide a single-ply, multi-panel envelope form wherein each of the panels are disposed in coplanar relationship during processing thereof and are adapted to receive original indicia.

It is, further, an object of the present invention to provide an envelope form which, when folded, defines an envelope including at least one interior panel having opposite side edges disposed inwardly from and free of interconnection with the sealed side edges of the envelope.

It is another object of the present invention to provide an envelope form wherein stuffer-insert material may be selectively inserted into the interior of the envelope prior to sealing thereof.

It is, yet, another object of the present invention to provide a method for making a series of end-to-end interconnected envelope forms as above described from a continuously advancing web of sheet material.

Other features and objects of the present invention will be readily apparent from the accompanying drawings and description.

BRIEF DESCRIPTION OF THE DRAWINGS

FIGS. 4–18 illustrate an embodiment of the form produced by the method of FIGS. 1–3, the resulting sealed envelope obtained therefrom and the means and methods for opening same.

FIGS. 19–21 diagrammatically illustrate steps in the method of making a continuous series of envelope forms similar to the forms of FIGS. 1–18, adapted for use with transfer imprint printing techniques.

FIGS. 22–32 illustrate an embodiment of the form produced by the method of FIGS. 19–21, the resulting record sheet and sealed envelope obtained therefrom, and the means and methods for opening the envelope thereof.

FIGS. 55–57 diagrammaticalaly illustrate steps in the method of making a continuous series of envelope forms, wherein an even number of intermediate panels is disposed between each set of envelope defining panels.

FIGS. 58–60 illustrate one embodiment of the form produced from the method of 55–57, the resulting sealed envelope obtained therefrom, and the means and method for opening same.

DESCRIPTION OF THE PREFERRED EMBODIMENTS

Figure 1:
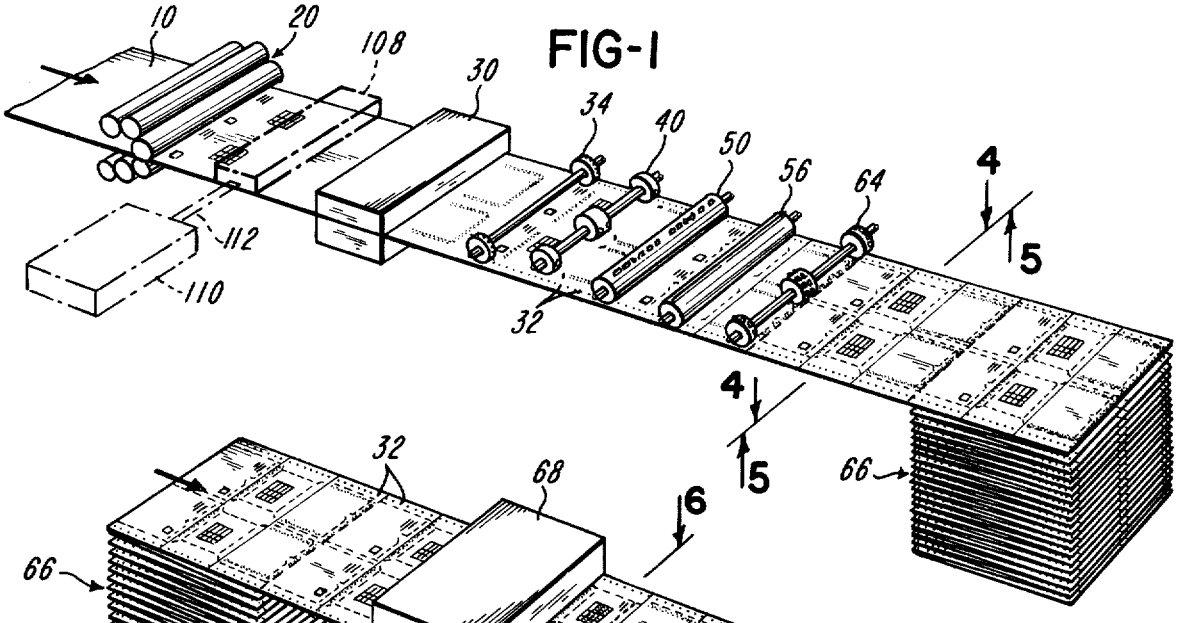
FIGS. 1–3 diagrammatically illustrate steps in the method of making a continuous series of envelope forms wherein one intermediate panel is disposed between each set of envelope defining panels.

Broadly speaking, the forms of the present invention are defined by a pair of coplanar mailing envelope-defining panels P and R separated by at least one end-connected, intermediate data panel Q coplanar and integral therewith, wherein the opposite side edges 59, 62 of panel Q and the side edges of all additional intermediate panels are disposed inwardly of the corresponding opposite side edges 58, 61 and 60, 63 of panels P and R. The forms comprise a single ply layer of sheet material and may be readily produced in an end-to-end interconnected series from a continuous web or in the alternative may be separately produced from a single sheet of material.

Each of the forms of the present invention is adapted to be subsequently folded into sealed envelope status, containing at least one intermediate data panel which may be readily removed by access means provided in one marginal edge of the sealed envelope.

A first embodiment of the present invention is ilustrated in FIGS. 1–18, wherein each form is defined by a pair of envelope-defining panels P and R separated by one intermediate, data panel Q. The form may be produced from continuous web of sheet material 10 which is advanced through the steps in the method diagrammatically illustrated in FIG. 1, wherein repetitive indicia such as, by way of example, address 12, postage permit 14, box 16 and lines 18, see FIG. 4, are conventionally printed at station 20, stripes 22–29 of self-seal, dry or other suitable adhesive are applied at station 30, line holes 32 are punched at station 34, diagonal perforated lines 36–39 and notches 48 and 49 are cut by a typical corner-cut unit at station 40, transverse perforated lines 42–46 are supplied at cross perforating station 50, transverse fold lines 52 and 54 are supplied at cross scoring station 56, and longitudinal perforated lines 58–63 are supplied at length perforating station 64. The continuous series of forms is then suitably accumulated in a convenience pack at station 66. The convenience pack, it will be noted, provides a method for storing the forms in sequential order while such are maintained as an integral part of the advancing web. Generally, the forms are sequentially folded at a preselected transverse perforation or score line into the accordion fold relationship illustrated. It should of course be understood where self-seal, dry adhesive or the like is utilized care should be taken to preclude premature contact of the various adhesive bearing areas of the form with other areas having a like adhesive thereon.

Figure 4:
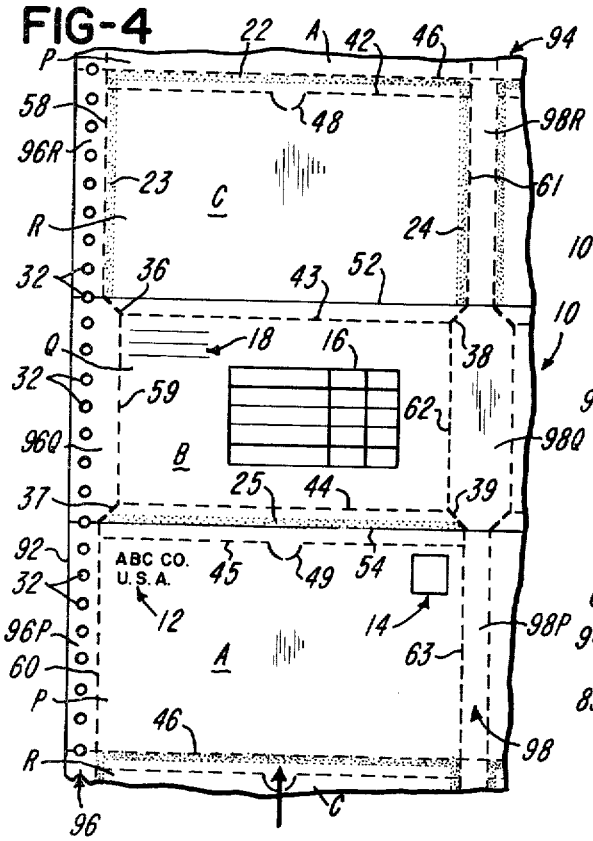
Figure 5:
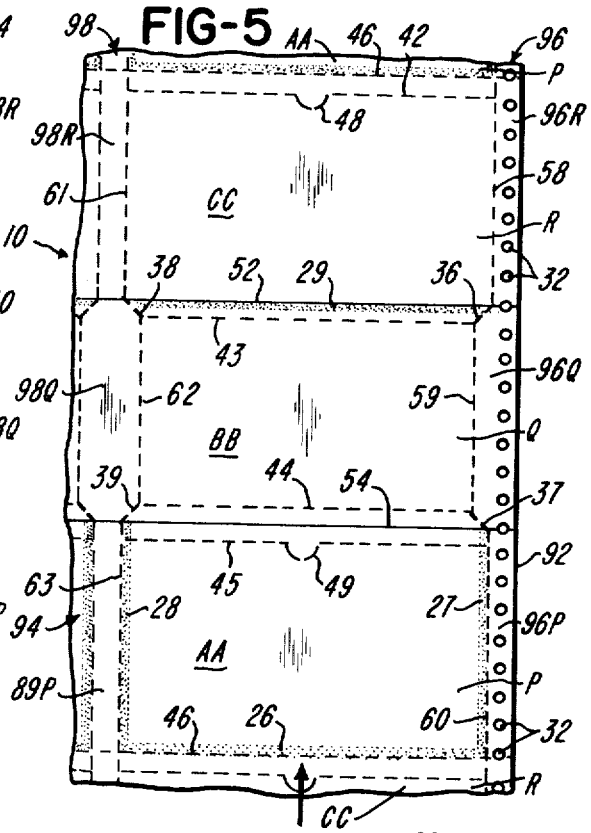
Figure 6:
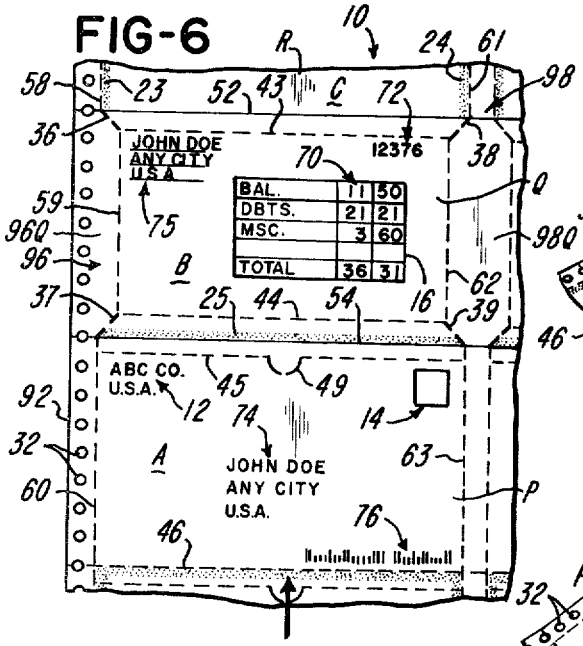

As illustrated in FIGS. 4 and 5, the forms accumulated at 66 are complete and are properly prepared for subsequent processing into sealed envelopes. Each form longitudinally spans the distance between adjacent perforated lines 46 and is subdivided into three panels P, Q and R by score lines 52 and 54. The upper surfaces of panels P, Q and R are identified A, B, C (FIG. 4) and the lower surfaces thereof are identified AA, BB, CC (FIG. 5), respectively. End-to-end interconnected length perforations 36, 37, 58, 59 and 60 delineate one of the side edges of panels P, Q, and R disposed inwardly of web edge 92, defining edge-adjacent trim-strip 96 which comprises segments 96P, 96Q and 96R. End-to-end interconnected length perforations 38, 39, 61, 62 and 63 likewise delineate the opposite side edges of panels P, Q and R disposed inwardly of the adjacent series of forms 94, defining median trim-strip 98 which comprises segments 98P, 98Q and 98R. It should, of course, be understood that web 10 may be of any desirable width and may accommodate a single continuous series of forms or a plurality thereof disposed in side-by-side relationship, as illustrated.

The forms accumulated at 66 are subsequently advanced through station 68 or the like, see FIG. 2, wherein variable indicia, unique to each form, such as, by way of example, invoice information 70, account number 72, name and address 74, 75 and bar code 76 is applied to the upper surface of the form, after which the printed forms are accumulated in a convenience pack at station 78.

Station 68 my comprise any of a variety of means for applying variable indicia such as, by way of example, an office typewriter, a computer controlled printer, or the like.

Figure 3:
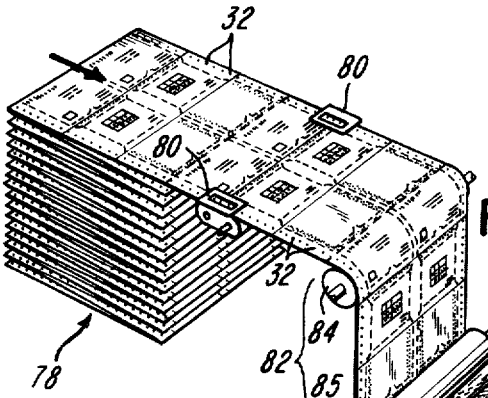

Once printed, the forms are advanced through the final processing steps as illustrated in FIG. 3, wherein each form is subjected to folding, sealing and bursting operations and, where desired, to a stuffing operation. As particularly illustrated in FIG. 8, each form is Z folded about lines 52 and 54 at station 82, diagrammatically illustrated by rolls 84, 85 and 86, disposing panels P, Q and R in registered relationship, wherein surfaces A, BB and C are upwardly disposed and surfaces AA, B and CC are downwardly disposed. After the panels of each form have been disposed in face abutting relationship, trimstrips 96 and 98 are removed at station 100 and the corresponnding mated adhesive stripes are pressed into permanent contacting relationship at station 102, sealing the various panels relative to one another. The resulting sealed envelopes are then severed from the continuous series at bursting station 104 for distribution as individual items as shown at 106.

Where desired, stuffer-insert 88 may be inserted between two panels of the form at station 89, wherein two adjacent panels Q and R are maintained in open relationship after folding thereof at station 82. Stuffer-insert 88 comprising, for example, advertising brochures, sample products, or the like, may be inserted between the open panels at station 89 and the panels are thereafter closed at station 90, housing the stuffer-insert therebetween. Generally, the stuffer-insert will be of a dimension such that the peripheral edges thereof are disposed inwardly of any adhesive strips on the panels of the form.

Figure 2:
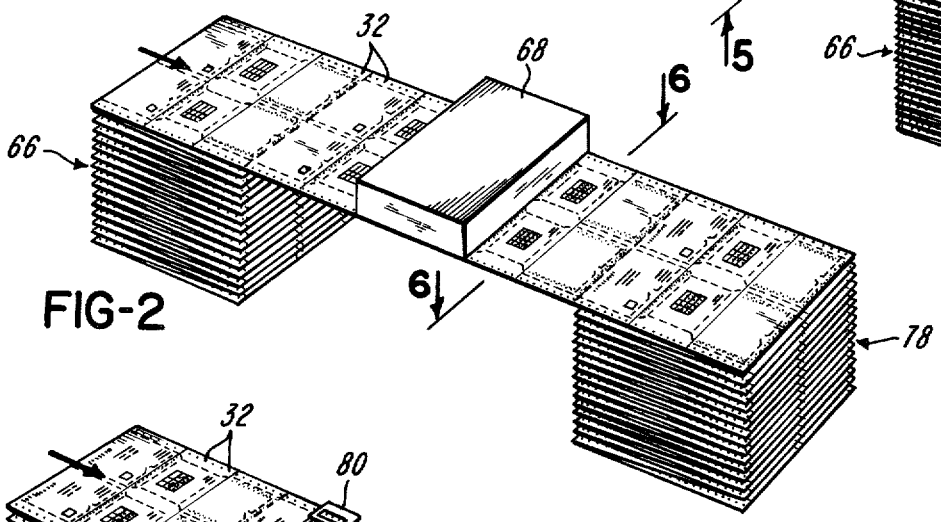
Figure 7:
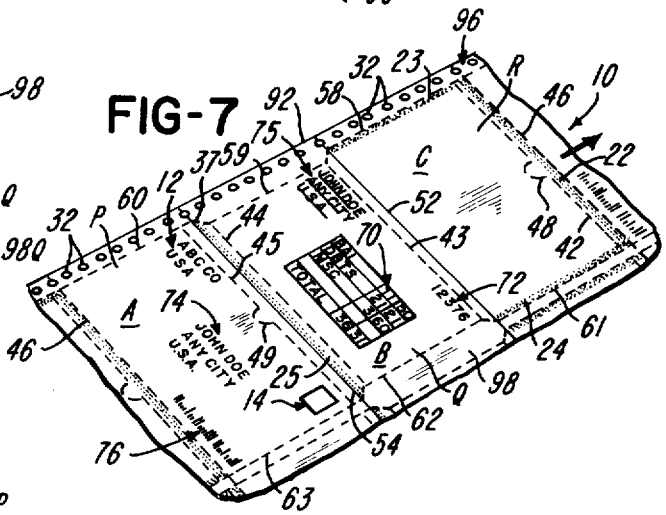
Figure 8:
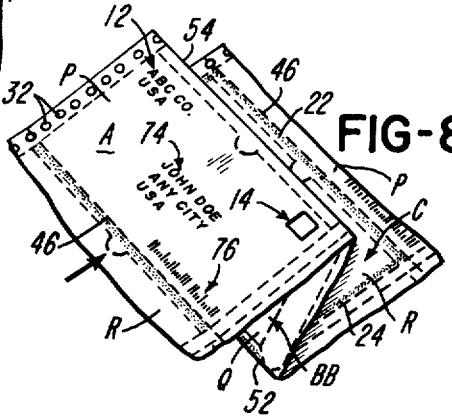

It should be noted that a number of alternate steps may be incorporated in the method of FIGS. 1–3 without departing from the scope and spirit of the present invention. In particular, it should be understood the sequence of events should not be considered as limiting and that several of the various steps may be performed in any suitable order. Further, it is often desirable to utilize a jet printing apparatus, wherein the variable indicia may be applied to the moving web at high speeds, eliminating the necessity of accumulating the forms at 66, subsequent advancement thereof through printer 68, and further accumulation of the forms at 78. This modification is illustrated in phantom in FIG. 1, wherein a so-called jet printer 108 is adapted to apply variable indicia 70, 72, 74, 75 and 76 in advance of station 66, as illustrated in FIG. 7. Essentially, jet printing combines high speed printer 108 with computer control 110 or the like wherein computer produced program media such as, by way of example, tape 112, provides variable input to the printer, generating a controlled, variable indicia output therefrom. When jet printing techniques, as such, are utilized, the continuous series of forms advances directly from station 64 (FIG. 1) to fold mechanism 82 (FIG. 3). It should be here noted that tractor feed mechanism 80, 80 may be utilized to properly advance the series of forms through the final steps as illustrated in FIG. 3. Generally, when the forms are accumulated at 66 and again at 78, the web is not advanced through the stations of FIG. 3 while under tension, but is loosely unfolded from the convenience pack at station 78. Therefore, it is desirable that tractor feed mechanism 80, 80 be employed, wherein sprocket gears or the like sequentially engage line holes 32 and properly advance the series of forms toward fold mechanism 82. Where jet printing is utilized, the web is continuously under tension, and tractor mechanism 80, 80 is not required. Of course, line holes 32 are also eliminated with jet printing.

The self-seal dry adhesive applied at station 30 is but one of the many well-known adhesive means which may be incorporated in the form of the present invention. For example, a hot-melt glue of the type having an affinity for the surface of the web 10 when applied and thereafter quickly dried to a non-tacky, non-adhesive state, may be applied in lieu of stripes 22, 23, 24 and 29, eliminating the necessity of complementary stripes 26, 27, 28 and 25, respectively. Of course, pressure roll 102 would be then replaced with a heat-seal mechanism, in order to effect a sealing relationship between abutting surfaces of the various panels. Further, a heat-seal mechanism in combination with dry-seal paper of the type wherein contacting portions of each form are maintained in self-sealing relationship by the application of heat to selected portions thereof would altogether eliminate the need for station 30. In the event that dry-seal paper is utilized, heat would be selectively applied at station 102 to effect a seal between abutting panels in areas corresponding to the various tripes of adhesive. It should, of course, be understood that a cold-glue adhesive could be used, in which event the web speed would, in some instances, be reduced to allow a longer drying time to effect a proper seal between abutting panels.

Figure 17:
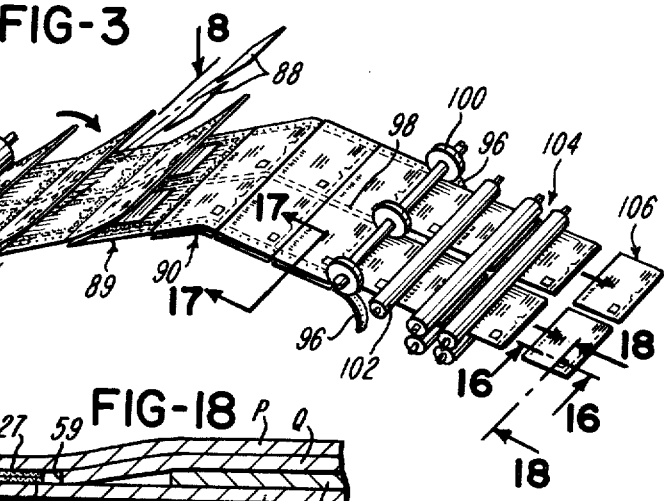
Figure 18:
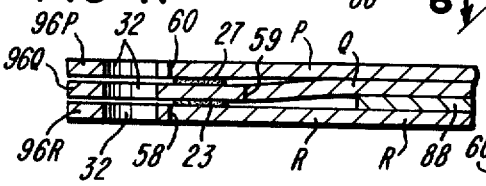
Figure 16:
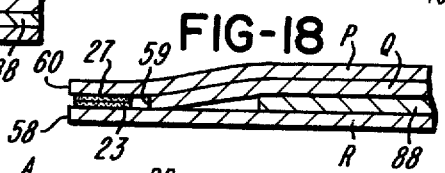
Figure 16:
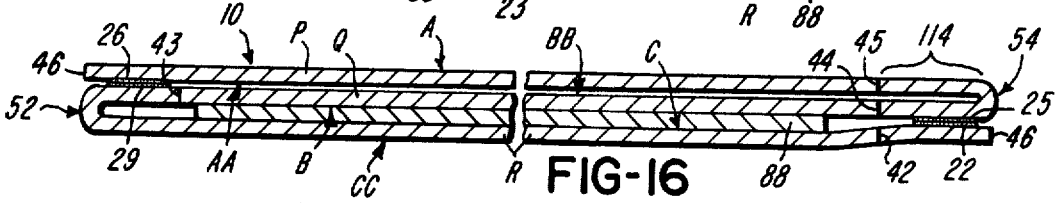

The resulting, sealed envelope, including means and methods for opening same, is illustrated in FIGS. 9–15. BY incorporating diagonals 36, 37 and 38, 39 with respective longitudinal lines 59 and 62, intermediate data panel Q is of a lesser width than either of the envelope panels P and R. Specifically, data panel Q is of a width such that the side edges thereof are disposed inwardly of adhesive stripes 23, 24 and 27, 28 on envelope panels P and R. As shown in FIGS. 17 and 18, here greatly enlarged, the panels are zig-zag folded about lines 52, 54, and trim-strip 96 is removed, disposing stripe 23, in contacting relationship with stripe 27, forming a sealing relationship at the corresponding side edges 58, 60 of the envelope panels P and R, wherein the side edge 59 of the intermediate data panel Q is disposed inwardly thereof. It should, of course, be understood that trim-strip 98 is similarly removed, disposing stripes 24 and 28 in adhesive contact wherein side edge 62 of panel Q is disposed inwardly thereof.

As illustrated in FIGS. 4 and 5, the top edge 46 of panel R on surface C thereof includes adhesive stripe 22 which is complementary with stripe 25 adjacent the bottom edge 54 of panel Q on surface B and effects a seal therebetween when the form is folded at line 52, and bottom edge 46 of panel P includes adhesive stripe 26 on surface AA which is complementary with adhesive stripe 29 adjacent the top edge 52 of panel Q on surface BB, and effects a seal therebetween when the form is folded at line 54. This is clearly illustrated in FIG. 16 taken at line 16—16 of FIG. 3, and here shown greatly enlarged. The remaining panel edges are maintained in proper relationship by the continuous characteristic of the form at lines 52 and 54.

Thus, the form of the present invention provides a sealed mainling envelope wherein the entire outer periphery of front and back envelope panels P and R are adhesively secured in envelope defining relationship to form a closed pocket therebetween for housing integral, intermediate data panel Q and, where desired, stuffer-insert 88.

Side edges 59 and 62 of data panel Q are disposed inwardly of the adhesively secured areas defined by stripes 23, 27, and 24, 28, respectively, and therefore are free of the sealed portion of the envelope side edges. Tear lines 42, 44 and 45 are disposed in corresponding registry inwardly of adhesive stripes 22 and 25 adjacent the resulting top edge of the envelope and, with corresponding notches 48 and 49, define stub 114 for gaining access to the interior of the envelope pocket. Tear line 43 in data panel Q provides means for separating the remaining data panel edge from the envelope assembly.

As illustrated in FIGS. 11–15, several alternate methods may be utilized to gain access to the interior of the envelope pocket, utilizing stub 114 and modifications thereof. Preferably, the top of the envelope will be grasped as in FIG. 11 with the thumb and forefinger engaging notches 48, 49 inwardly of line 44 on data panel Q. By similarly holding the bottom of the envelope and applying a quick, snap action, the stub will break loose along lines 42 and 45 and the data panel will break loose along line 43, permitting removal thereof in one single act. It should be noted that stuffer-insert 88 will also be removed by this act if the upper edge 120 thereof is in overlapping relationship with notches 48, 49, When such is not the case, the stuffer-insert may be manually removed once the envelope has been opened.

With particular reference to FIG. 13, it can be seen that the stub may also be removed by tearing along lines 42 44, and 45 without damaging the contents of the envelope, i.e., data panel Q and stuffer-insert 88. The data panel is then separated from the envelope at line 43 and withdrawn therefrom.

It may be desirable in some instances to provide stub 115 without notches 48, 49 (FIG. 14) wherein the preferred means of entry is by tearing, as shown. It should, of course, be understood that the envelope can also be opened by slitting or cutting the assembly at line 116 (FIG. 15), as with automatic letter-opening machinery or the like, after which the data panel may be removed as in the embodiment of FIG. 13.

Thus, it can be seen that the present invention provides a sealed mailing envelope assembly comprising data panel Q and front and back envelope panels P and R defined by a single ply of sheet material, wherein side edges 59 and 62 of the data sheet are freely disposed inwardly of the sealed side edges of the envelope, wherein access to the interior of the envelope and removal of the data sheets and other contents thereof is provided by means in one marginal edge thereof.

It should be noted that the resulting mailing envelope includes opposite folded edges, defined by lines 52 and 54, facilitating use of automated sorting equipment in conjunction therewith. In this regard, it is desirable that the bar coding system currently used by the United States Postal Service be incorporated in the address, such as, by way of example, bar code 76 included on surface A of envelope panel P as shown in FIG. 11. Generally, the bar code may be applied with the other variable indicia at station 68, in the alternative, jet printer 108.

A particularly advantageous featurre of the present invention lies in the fact that all panels of the form are in coplanar relationship prior to folding thereof, permitting single pass printing without the use of carbon or other transfer material. This is particularly desirable when bar coding is utilized, for when bar coding is applied by transfer techniques the density and definition thereof is not of the highest quality, making the code less readable by machine methods. This feature also eliminates the possibility of obscuring indicia contained on the data sheet with carbon smudges resulting from normal handling of mail.

Figures 19, 20, 21, 32:
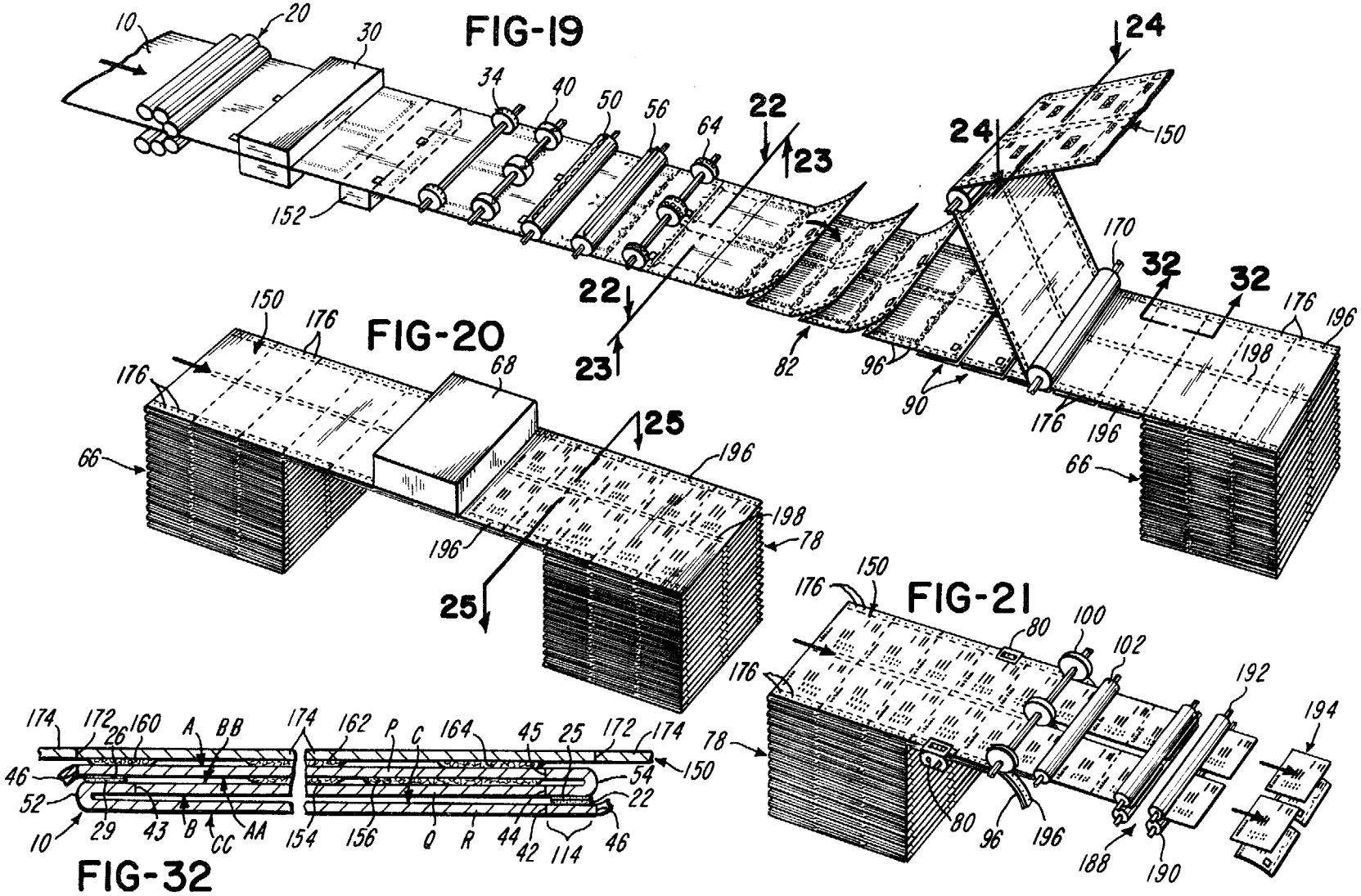

However, since a number of institutions presently using mass mailing techniques are set up for transfer printing operations, I have provided a form and method which is similar to that illustrated in FIGS. 1–18, which is compatible with transfer or imprint printing techniques, as illustrated in FIGS. 19–21. The form is shown at various stages of the process in FIGS. 22–32. In order to illustrate the similarities between embodiments of FIGS. 1–18 and embodiments of FIGS. 19–32, like reference numerals have been applied to identical steps and elements thereof, wherein web 10 is continuously advanced through printing station 20, glue station 30, carbon spot applying station 152, line hole punch 34, and cut, score and perforating stations 40, 50, 56, and 64, generating the forms illustrated in FIGS. 22 and 23. The forms are then folded about lines 52 and 54 at station 82 and are continuously collated at station 170 with record and transfer web 150, providing a series of end-interconnected forms and record sheets adapted to be thereafter subjected to imprint printing operations for application of variable indicia to selected portions of the various panels thereof.

Figure 22:
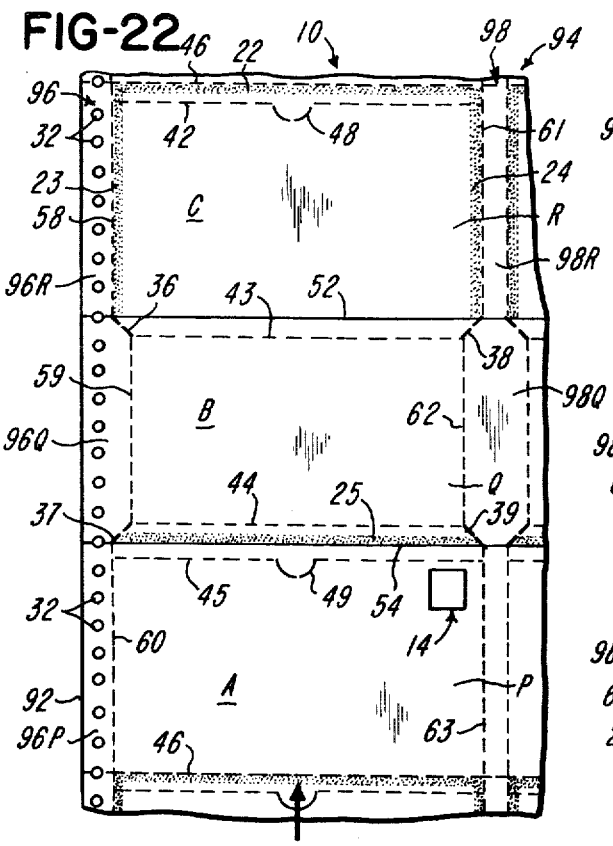
Figure 23:
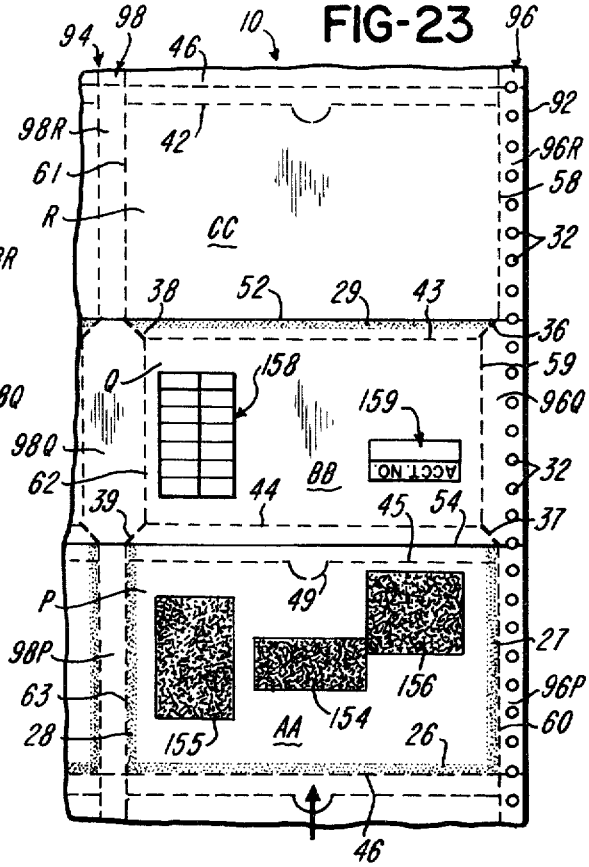
Figure 24:
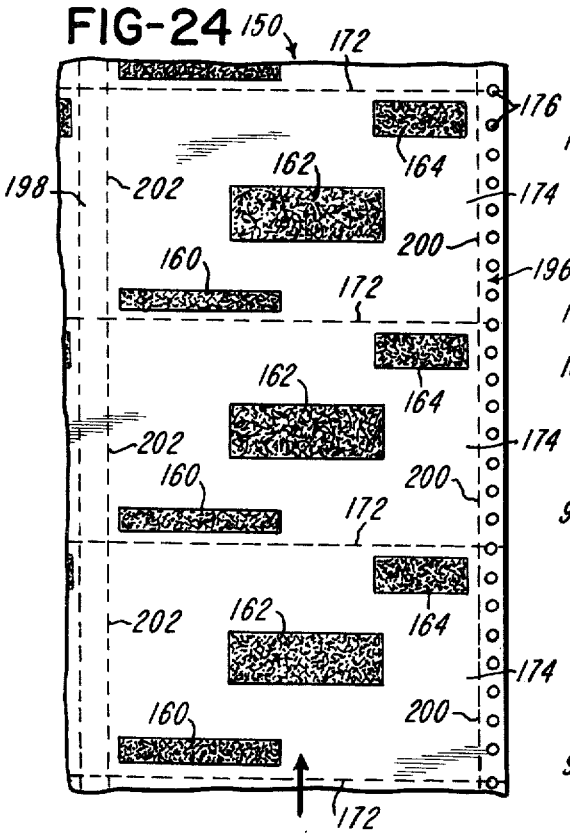

The form of FIGS. 19–21 differs from the form of FIGS. 1–18 in that repetitive indicia 158, 159 is disposed on surface BB of panel Q, see FIGS. 22 and 23, and carbon spots 154–156 are selectively applied to surface AA of panel P, see FIG. 23. Record and transfer web 150 includes carbon spots 160, 162, and 164, or the like, selectively applied to the underside thereof, see FIG. 24. Web 150 is subdivided by a series of transverse perforations 172 into a plurality of record sheets 174, wherein one each is adapted to be disposed in direct, overlying registry with each of the folded forms when web 150 is collated therewith at station 170. Line holes 176 included at the continuous, longitudinal boundaries are adapted to be placed in corresponding registry with line holes 32 in web 10 and ensure proper collation of the record and transfer sheets with the folded forms. Therefore, it is necessary that holes 32 in web 10 are disposed in corresponding registry with one another when the panels of each form are folded at station 82. This is provided when the holes are of the pattern illustrated in FIGS. 22 and 23, wherein the line holes are identically spaced and contained within the edge boundaries of each panel P, Q and R. It should, of course, be understood that other methods for ensuring proper collation of sheets 174 with the folded forms could be incorporated herein. Further, it should be here noted that the present modification of the form is not limited to use in combination with a single record sheet, but may, of course, be used in conjunction with any number of additional, collated sheets, and in some instances, the form may be used without the addition of any record or transfer plies.

The corresponding relationship of record sheets 174 and each envelope form comprising panels P, Q and R is illustrated in FIG. 26 and again in FIG. 32 taken at line 32—32, of FIG. 19, here shown greatly enlarged, wherein it can be seen that indicia printed on the upper surface of each record sheet 174 will be selectively transfer-imprinted on surface A of panel P by carbon spots 160, 162, and 164. Carbon spots 154, 155 (see FIG. 23) and 156 will likewise imprint selective indicia on surface BB of panel Q. It should, of course, be understood that stuffed insert 88 could be placed between panels Q and R subsequent to the fold station, if and when desired.

Figure 25:
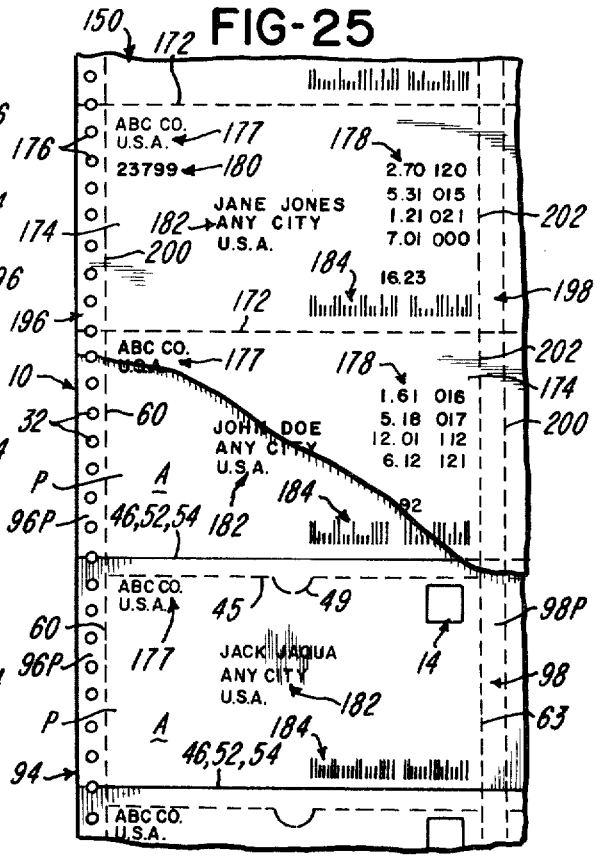

After the web 150 and forms of web 10 have been properly collated, the composite continuous series of forms and record sheets is accumulated at station 66 in the same manner as shown in FIG. 1. The sheets and forms are thereafter advanced through printing station 68, wherein variable indicia, such as by way of example, return address 177, invoice information 178, account number 180, address 182 and bar code 184 are directly imprinted on each record sheet, as shown in FIG. 25. Bar code 184, address 182, and return address 177 are transfer imprinted on surface A of outer envelope face panel P, and invoice information 178, return address 177, account number 180, and address 182 are transfer imprinted on surface BB of data panel Q, see FIG. 28. The printed forms are thereafter suitably accumulated at 78 of FIG. 20.

The forms and record sheets are subsequently advanced through the final steps of the method, as shown in FIG. 21, wherein station 100 removes trim-strips 96 and 98, and corresponding strips 196 and 198 defined by lines 200 and 202 on web 150, roll 104 effects a seal between panels P, Q and R of the basic form, see FIGS. 17 and 18, and modified burster 188 separates the record sheets at adjacent lines 172 and the completed envelopes at adjacent lines 46 into individual items, see FIG. 32. The record sheets are separated from the envelopes at 188 by controlling the relative speed of rollers 190 and 192, generating separate envelopes and record sheets for distribution at 194, as shown in FIGS. 26 and 27, respectively.

Tractor feed mechanism 80, 80 could, of course, be incorporated in the method of FIG. 21 as discussed elsewhere herein. It should be understood that when the series of forms is advanced through the steps of FIG. 21 while under tension, tractor feed mechanism 80, 80 and lines holes 32 would not be required.

FIGS. 28–31 illustrate the various means and methods for opening the envelope form of FIGS. 22–27 and correspond to FIGS. 12–15, respectively.

Figure 33:
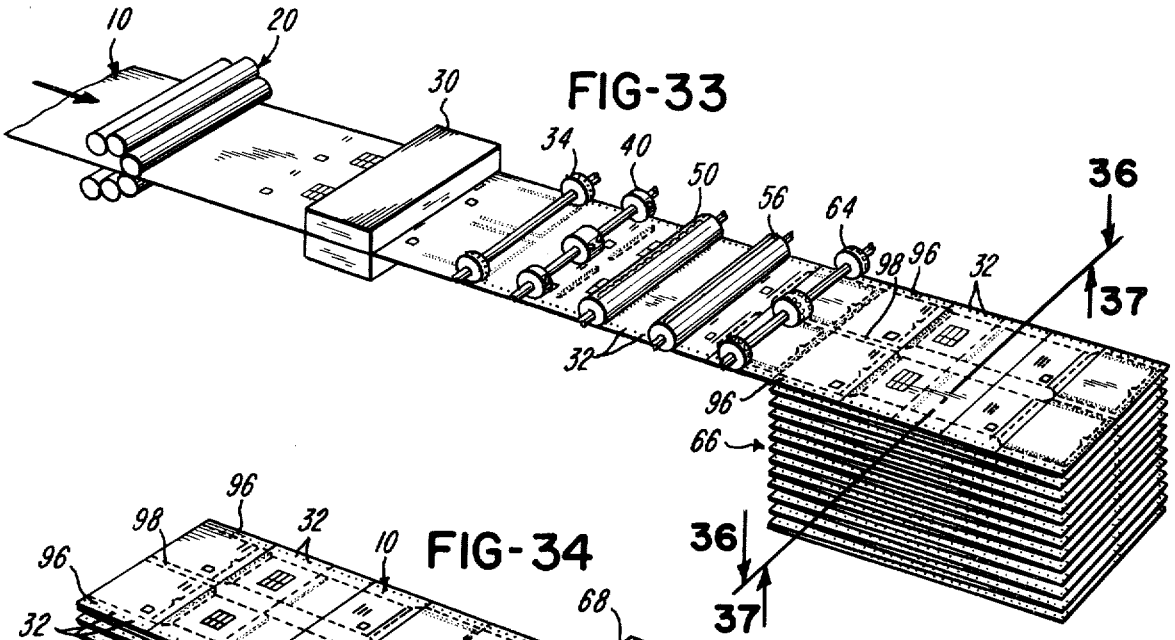
FIGS. 33–35 diagrammatically illustrate steps in the method of making a continuous series of envelope forms, wherein an odd number of intermediate panels are disposed between each set of envelope defining panels.
Figure 34:
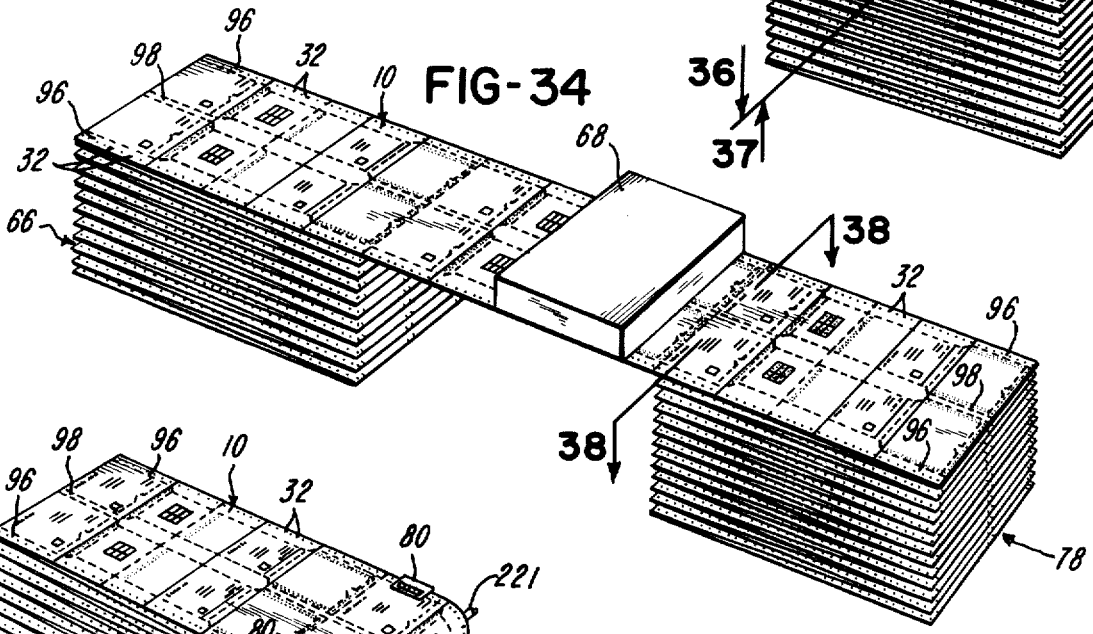
Figure 35:
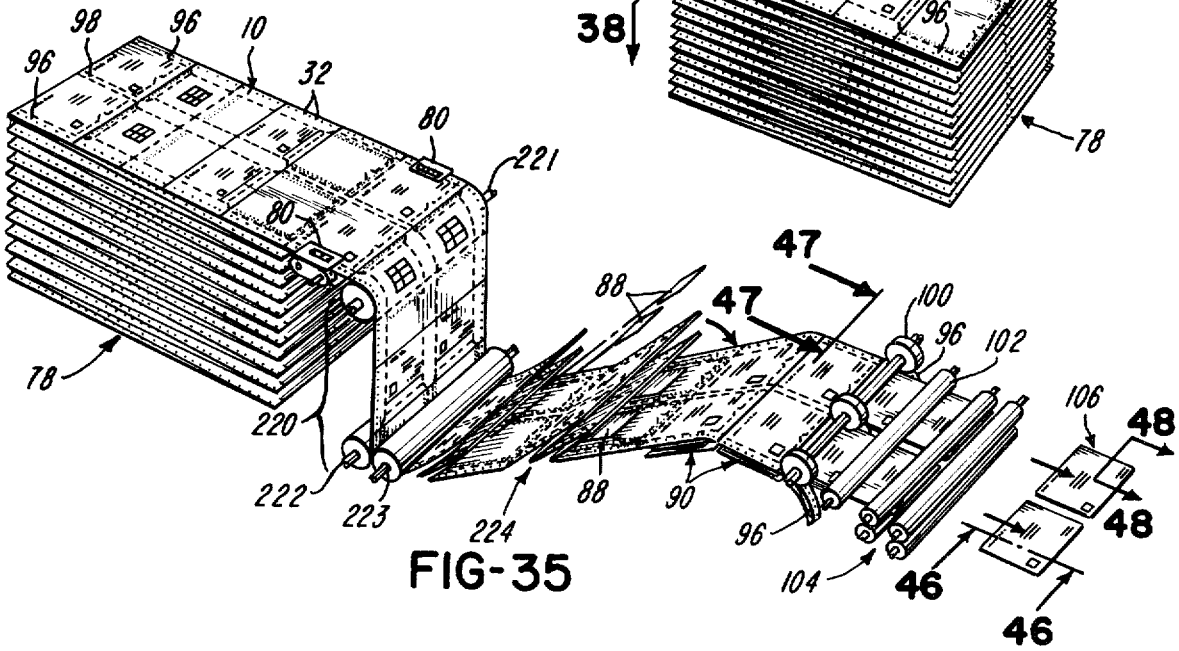
Figure 36:
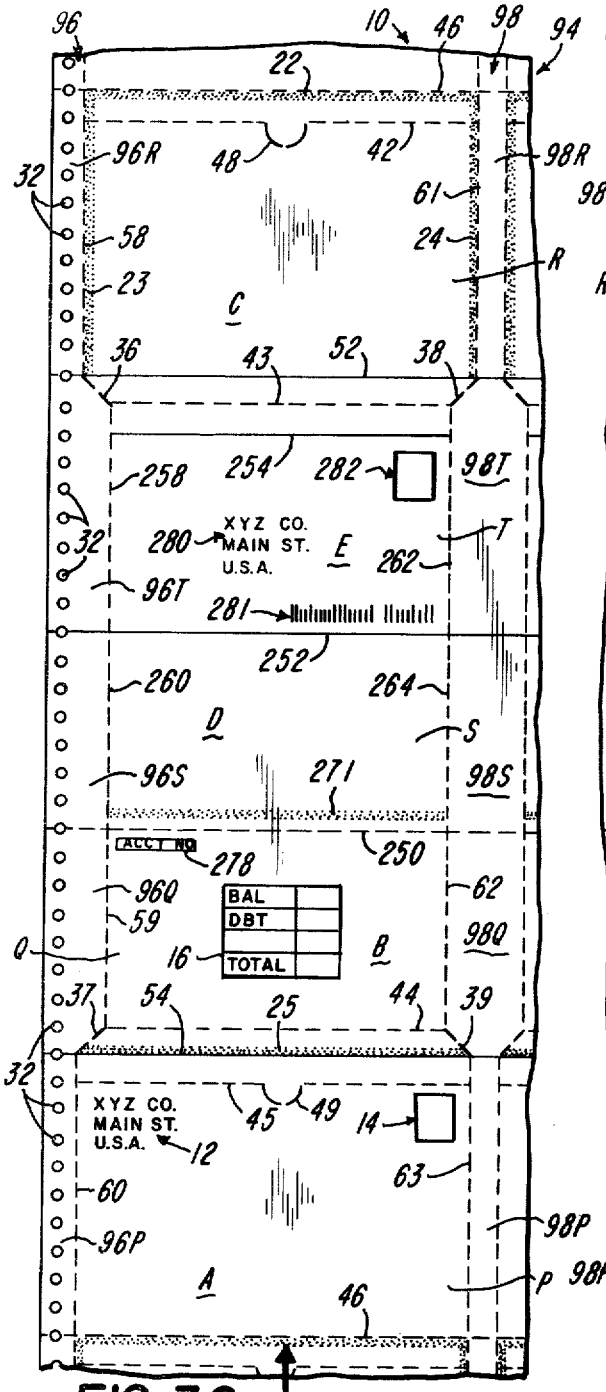
FIGS. 36–48 illustrate one embodiment of the form produced by the method of FIGS. 33–35, the resulting sealed mailing envelope and integral return envelope obtained therefrom, and the means and methods for opening same.
Figure 37:
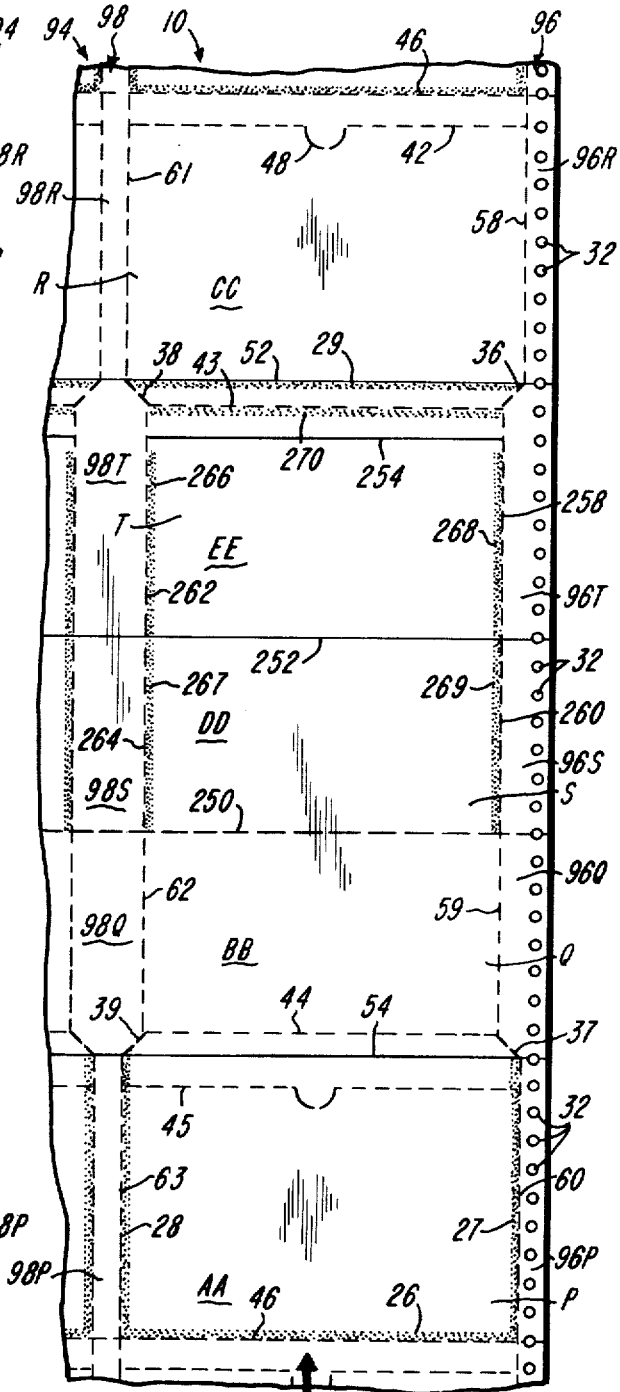
Figure 38:
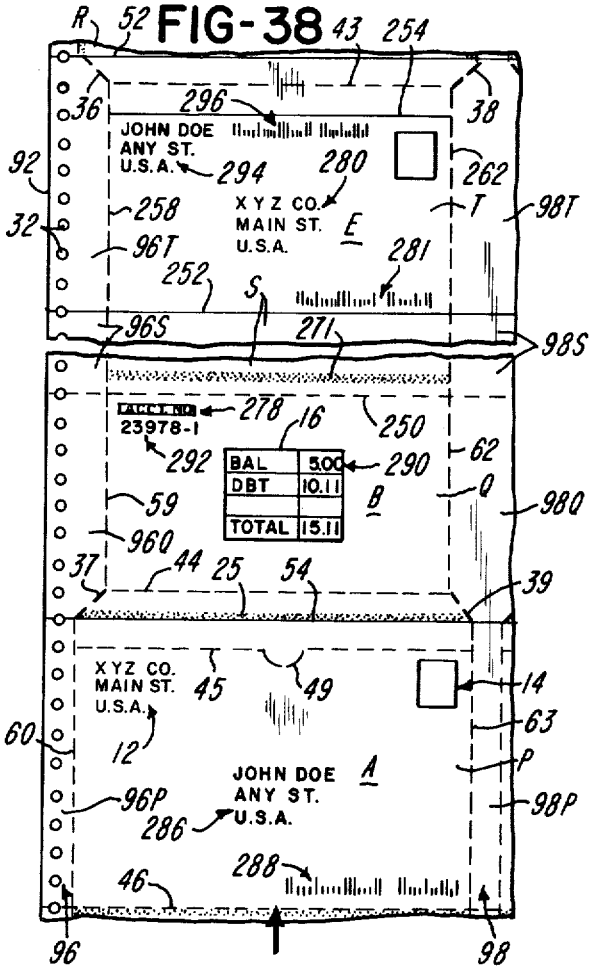

FIGS. 33–35 illustrate steps in the method of producing other modifications of the envelope form of the present invention, each including an odd number of intermediate panels disposed between each set of envelope defining panels. FIGS. 36–48 illustrate a first form produced therefrom comprising five panels P, Q, R, S and T wherein panels S and T define a return envelope integral therewith. FIGS. 49–53 illustrate a second form produced therefrom comprising seven panels P, Q, R, U, V, W, and X. The form of the present invention may, of course, comprise any number of panels wherein there is included at least the three basic panels P, Q, and R.

Specifically, to produce the five panel web of FIGS. 36–48, the method of FIGS. 33–35 differs from that of FIGS. 1–3 in that printing station 20 provides additional repetitious indicia such as, by way of example, block 278 on surface B, and address 280 and postage box 282 on surface C, perforating station 50 has been modified to further provide additional transverse perforated line 250 separatinng panels Q and S, scoring station 56 provides additional transverse fold lines 252 and 254 wherein line 252 separate panels S and T, longitudinal perforating station 64 adds additional longitudinal lines 258 and 260 connecting line 59 with diagonal 36, and lines 262 and 264 connecting line 62 with diagonal 38. Further, station 30 has been modified to apply additional stripes of dry self-seal adhesive 266, 267, 268, 269, 270 and 271. The method thus modified produced the form illustrated in FIGS. 36 and 37 taken at lines 36—36, 37—37 of FIG. 33, respectively, wherein the upper surfaces of panels P, Q, R, S, and T are denoted A, B, C, D and E, and the corresponding lower surfaces are denoted AA, BB, CC, DD and EE, respectively. The forms are accumulated at 66, and are subsequently advanced through printing station 68 wherein address 286, including bar code 288, is applied to surface A of panel P, invoice information 290 and account number 292 are applied to surface B of panel Q, and return address 294 for the return envelope, including bar code 296, are applied to surface E of panel T, see FIG. 38, after which the forms are accumulated at 78, see FIG. 56.

Figure 39:
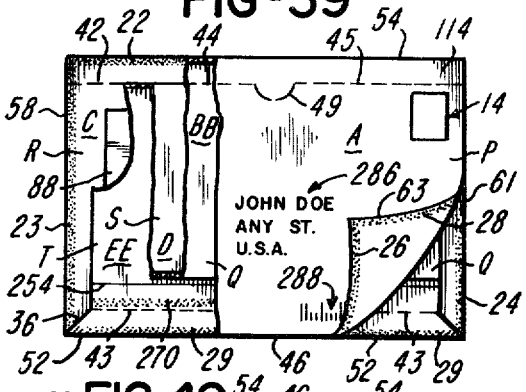
Figure 40:
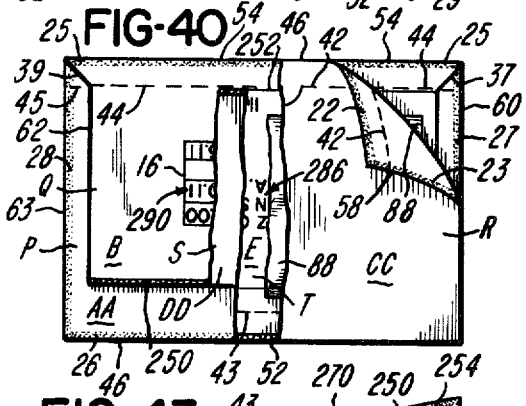
Figure 43:
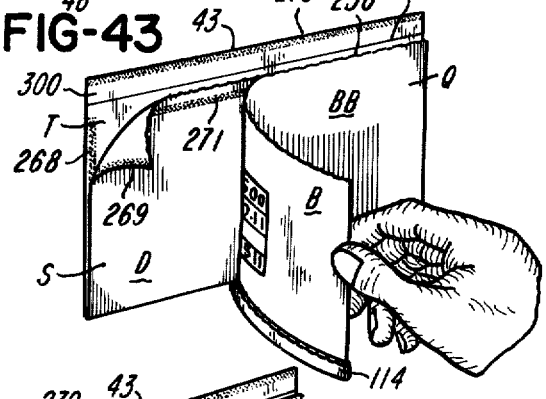
Figure 41:
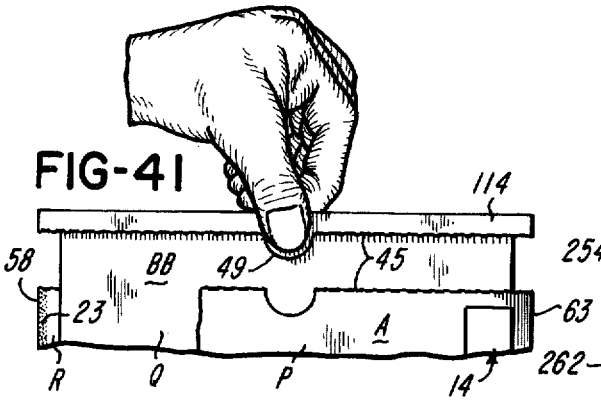

The series of forms is thereafter advanced through the final processing steps of FIG. 35 wherein various line holes 32 are engaged by tractor feed mechanism 80, 80, where used, for advancing the forms through modified zig-zag fold station 220. The fold station is diagrammatically illustrated by rolls 221, 222, 223, wherein each form is folded at lines 52, 252, 250 and 54 disposing the various panels thereof in direct, corresponding registry as particularly illustrated in FIG. 46 taken at line 46—46 of FIG. 35, and here shown greatly enlarged. Where desired, stuffer-insert 88 may be interposed between panels T and R in the manner described elsewhere herein. Trim-strip 96, comprising sections 96P, 96Q, 96R, 96S and 96T, and trim-strip 98 comprising sections 98P, 98Q, 98R, 98S and 98T, are removed at station 100, a seal is effected between complementary stripes of adhesive at station 102, and the resulting individual envelopes are severed from the series at station 104 for distribution at 106, as illustrated in FIGS. 39 and 40.

Figure 47:
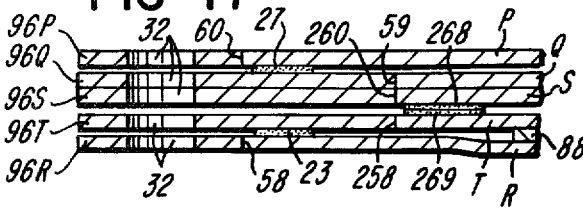
Figure 48:
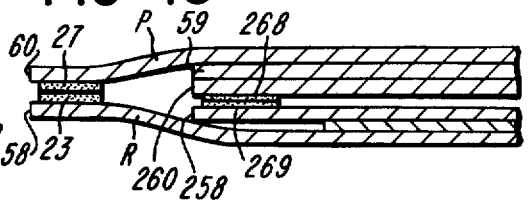

Panels S and T, like panel Q, are of lesser width than mailing envelope panels P and R, permitting adhesive bonding of side edges 58, 60 and 61, 63 to one another without interference, as illustrated in FIGS. 47 and 48, taken at lines 47—47 and 48—48 of FIG. 35, respectively, and here shown greatly enlarged. Trim-strip 96, particularly segments 96Q, 96S and 96T thereof, preclude contact between complementary adhesive stripes 23 and 27. When the trim-strips are removed, see FIG. 48, stripe 23 is disposed in contacting relationship with stripe 27, securing front envelope panel P to rear envelope panel R, wherein edges 59, 260 and 258 of panels Q, S and T, respectively, are disposed inside the stripes of adhesive and are loosely housed in the pocket defined by panels P and R. It should be understood that similar removal of strip 98 effects a sealing relationship between complementary stripes 24 and 28 at side edges 61 and 63.

Figure 42:
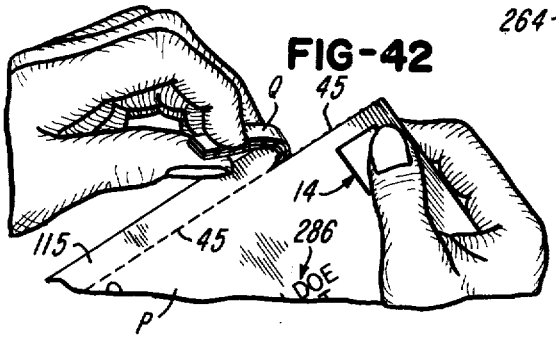
Figure 46:
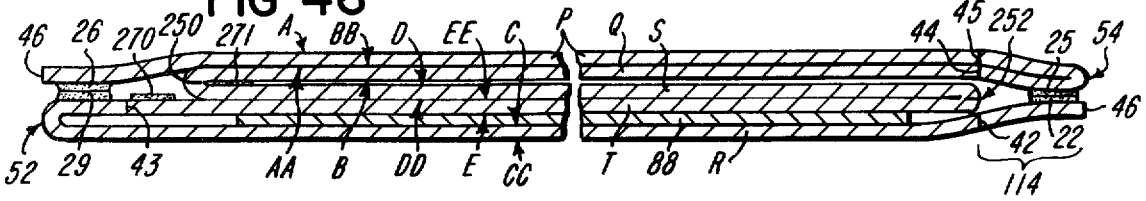

Panels S and T are folded at line 252, wherein surfaces DD and EE and complementary stripes of adhesive 266, 267 and 268, 269 thereon are disposed in contacting relationship (FIGS. 47, 48) to effect a seal therebetween defining a return envelope pocket. As illustrated in FIG. 46, taken at line 46—46 of FIG. 39, complementary adhesive stripes 26, 29 and 22, 25 and fold lines 52 and 54 form sealed bottom and top edges of the assembly, respectively, as with each of the earlier embodiments. By providing intermediate panels Q, S and T of a lesser longitudinal height than panels P and R, the form is zig-zag folded as illustrated in FIG. 46, wherein panels Q, S and T are each disposed inwardly of the top and bottom envelope edges as defined by adhesive stripes 22, 25, and 26, 29, respectively. As in previous embodiments of the form, the intermediate panels are attached to the envelope panels P and R at lines 44 and 43, respectively. Lines 42, 44 and 45, with notches 48, 49, define stub 114 and provide access to the interior of the resulting sealed envelope. As with each of the earlier forms, the envelope may be snap-opened (FIG. 41) or torn (FIG. 42). In the event the envelope is to be torn, notches 48, 49 may be eliminated, resulting in stub 115.

As particularly illustrated in FIG. 46, when stub 114 is snapped from the envelope at lines 42 and 45 the thumb and forefingers will tightly hold interior panels Q, S and T between notches 48 and 49, breaking panel T from the assembly at line 43, permitting easy removal thereof. Once panels Q, S and T have been thus removed, panel Q may be removed at line 250 from the return envelope defined by panels S and T, see FIG. 43.

Figure 44:
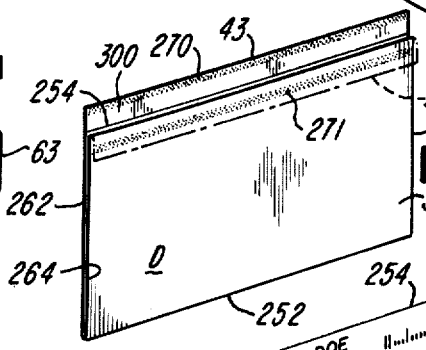
Figure 45:
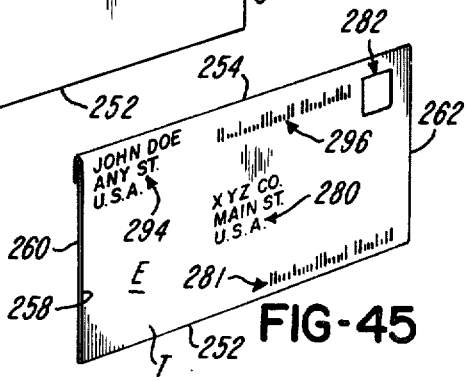

The return envelope is illustrated in FIGS. 44, wherein flap 300 is defined by fold line 254 and edge 43 of panel T. Complementary adhesive stripes 270 and 271, on surfaces D and E respectively, provide adhesive for sealing the envelope when flap 300 is folded at line 254, as shown in phantom in FIG. 44, after which the envelope may be mailed as shown in FIG. 45.

An advantageous feature of the return envelope of the present invention results from the fact that the panels of the form are all coplanar during processing. This permits single pass printing of variable indicia thereon, wherein return address 294 and bar code 296 may be readily supplied to surface E of the return envelope panel T.

It can be seen, therefore, that the present invention provides a form wherein a mailing envelope, a data sheet, and a return envelope are all generated from a sheet of single ply material which is sub-divided into a plurality of panels adapted to be disposed in zig-zag folded relationship, wherein the assembly can be opened along one edge and the various components readily separated therefrom. It should, of course, be understood that the various other alternatives discussed herein, such as, by way of example, transfer printing, jet printing, alternate adhesive means, and addition of stuffer-inserts 88 could be incorporated in the form of FIGS. 36–48 without departing from the scope and spirit of the present invention.

FIGS. 49–53 illustrate another modification of the invention resulting from the method of FIGS. 33–35, wherein each form includes seven panels, i.e. four panels U, V, W and X in addition to the three basic panels P, Q and R. It should be understood that the various steps in the method are modified to provide the required perforated and score lines, repetitious indicia, and stripes of adhesive. Further, it should be understood that any of the various alternatives previously described herein may be incorporated in the form of FIGS. 49–53 without departing from the scope and spirit of the present invention.

Figure 49:
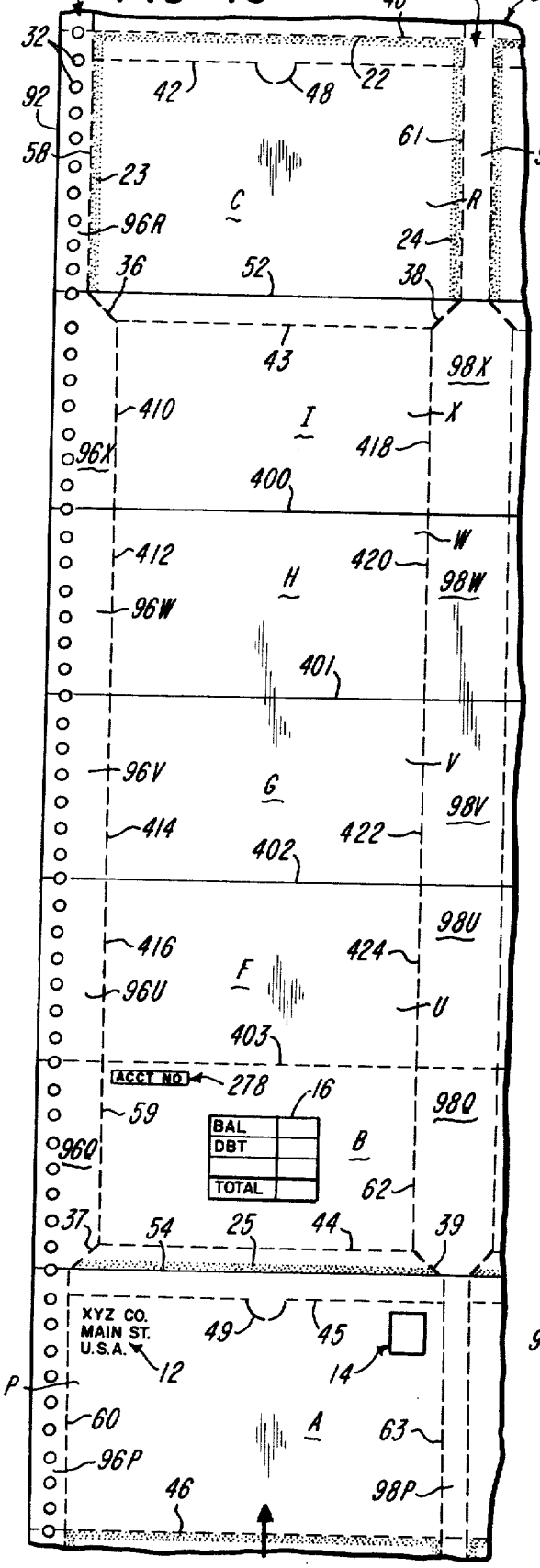
Figure 50:
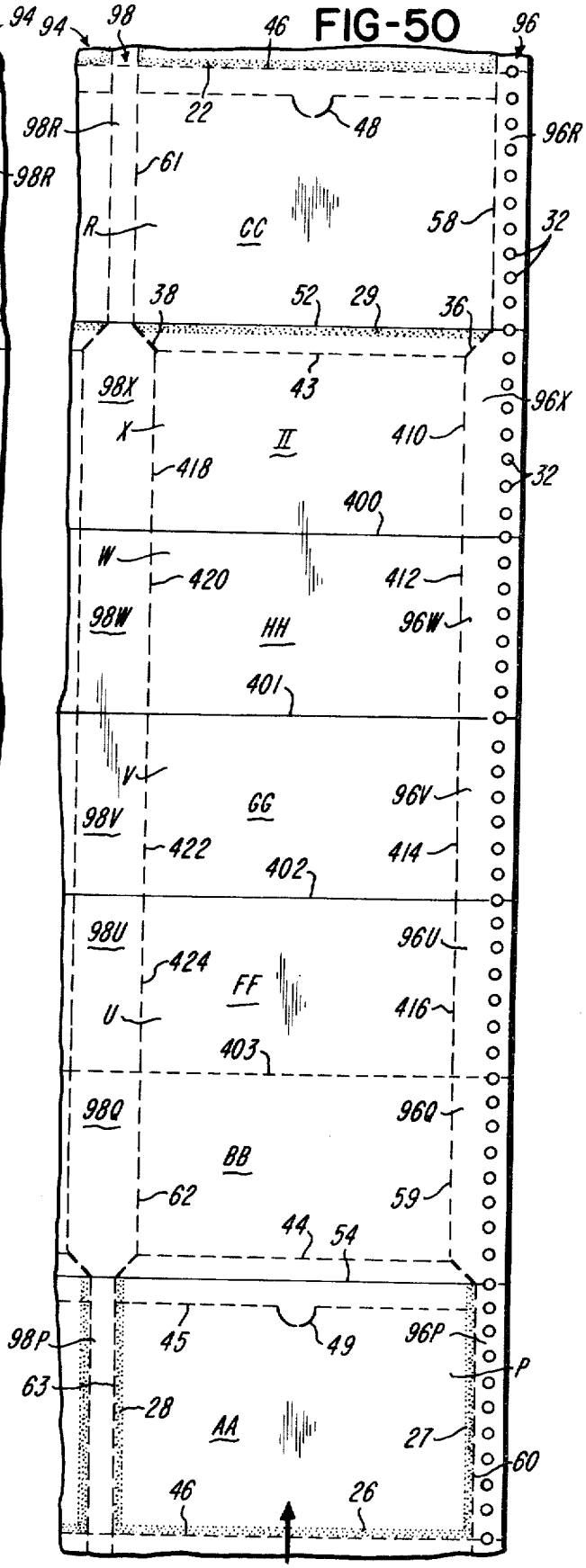

A single form, comprising seven panels, P, Q, U, V, W, X and R, is illustrated in FIGS. 49 and 50 wherein the upper surfaces of the panels are designated A, B, F, G, H, I and C and the corresponding lower surfaces of the panels are designated AA, BB, FF, GG, HH, II and CC, respectively. As will be readily noted from the drawings, that portion of the form which generally defines panels P, Q, and R corresponds to each of the previous embodiments. A plurality of intermediate panels U, V, W and X, each of which may be of the same or different heights, but all of which are of a lesser width than panels P and R, are disposed intermediate lines 52 and 403.

As in each of the previous embodiments, fold lines 52 and 54 are located at one edge of panels P and R. Fold lines 400, 401, 402 and combination fold/tear line 403 defines the boundaries between panels X, W, V, U and Q, respectively. Lines 410, 412, 414 and 416 connect line 59 with diagonal 36, and with lines 58 and 60 and diagonal 37, define continuous trim-strip 96 comprising segments 96P, 96Q, 96U, 96V, 96W, 96X and 96R. Lines 418, 420, 422, and 424 connect lines 62 and diagonal 38 and, with lines 61 and 63 and diagonal 39, define trim-strip 98 comprising segments 98P, 98Q, 98U, 98V, 98W, 98X and 98R.

Figure 51:
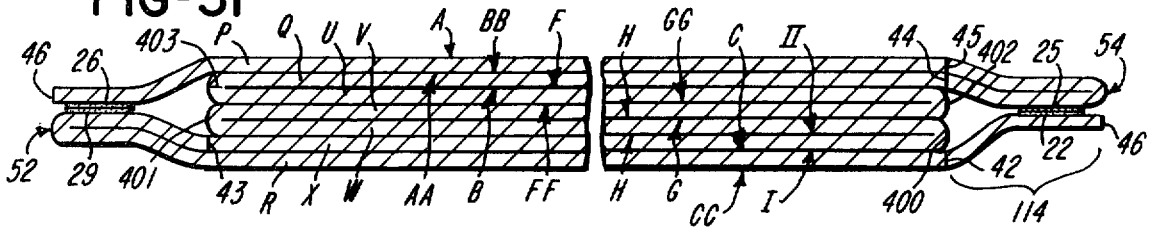
FIGS. 49–54 illustrate another embodiment of the form produced by the method of FIGS. 33–35, the resulting sealed mailing envelope obtained therefrom, and the means and methods for opening same.
Figure 52:
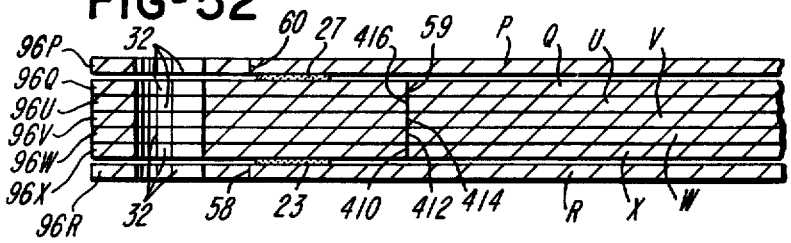
Figure 53:
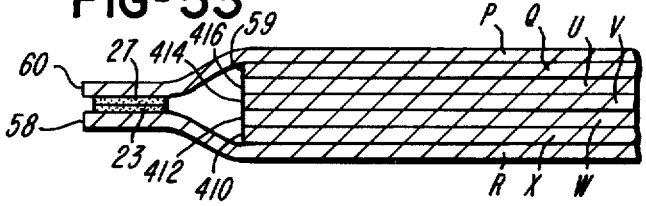
Figure 54:
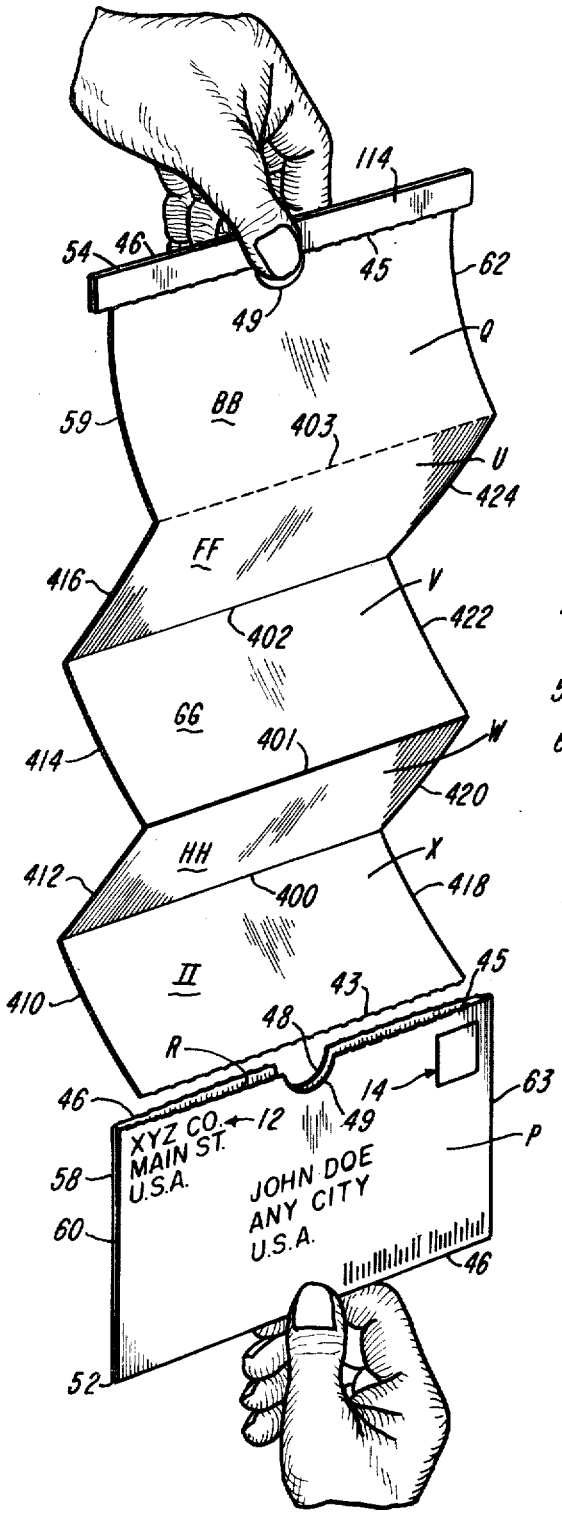

Fold station 220 is modified to zig-zag fold the seven panels as illustrated in FIGS. 51–53, wherein complementary adhesive stripes 26, 29, and 22, 25 are disposed in contacting relationship as shown in FIG. 51 and the intermediate panels are connected thereto at lines 43 and 44, as in each of the earlier embodiments. As shown in FIGS. 52, trim-strip 96, particularly segments 96Q, 96U, 96V, 96W and 96X thereof, precludes contact between complementary adhesive stripes 23 and 27 until removed at station 100, after which panels P and Q are adhesively secured to one another and ends 59, 416, 414, 412 and 410 of panels Q, U, V, W and X, respectively, are disposed inwardly thereof (FIG. 53). It should be understood that removal of trim-strip 98 likewise permits contact between complementary stripes 24, 28 with edges 418, 420, 422, 424 and 62 of the intermediate panels disposed inwardly thereof. When stub 114 is snapped from envelope panels P and R, the entire series of intermediate panels is detached at line 43 and removed from the envelope pocket, as shown in FIG. 54. Of course, line 44 is provided to permit tearing of stub 114 from the envelope, if such is desired. Line 403 is perforated and permits ready separation of panels U, V, W and X from data panel Q, if and where desired. Fold lines 400, 401 and 402 are perforated of scored, as dictated by the intended use of the particular form.

Panels Q, U, V, W and X can be used for any desirable purpose and may, of course, be imprinted with both repetitious and variable indicia. It should be understood that the various alternate features described herein, including a discussion of return envelope panels S and T, and stuffer-insert 88 may be incorporated in this modification of the invention.

Figure 60:
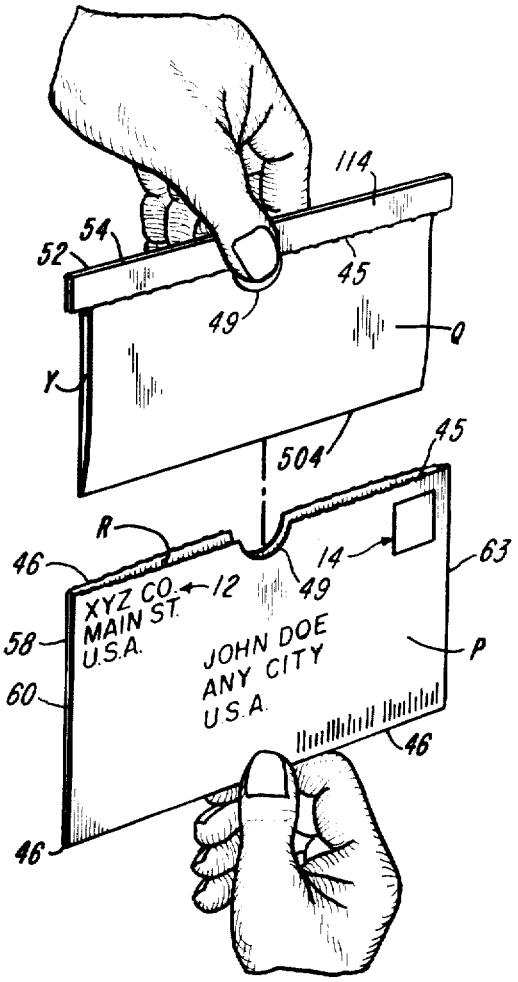

FIGS. 55–57 illustrate steps in the method of producing a modification of the form of the present invention wherein an even number of intermediate panels are disposed between each pair of envelope defining panels. FIGS. 58 and 59 are section views taken at lines 58—58 and 59—59 of FIG. 57, respectively, and illustrate the resulting sealed envelope, here shown greatly enlarged. FIG. 60 illustrates one suitable means and the associated method for opening the envelope. The forms particularly illustrated each include four panels P, Q, R, and Y, which are generated from a continuous web of sheet material 10 advanced through the stations of FIG. 55 and accumulated in a convenience pack at station 66. It will be noted drom the drawings that FIG. 55 corresponds generally to FIGS. 1 and 33, wherein the various stations thereof are modified to provide the indicia, adhesive stripes and score and perforation lines required to define the desired forms. Specifically, the form is expanded to include panel Y between panels Q and R, wherein transverse score line 504 defines the boundary between panel Q and Y and transverse score line 518 defines the boundary between panels Y and R, perforations 510 and 512 define the side edges of panel Y and correspond with side edges 59 and 2 of panel Q, and complementary adhesive stripes 506 and 508 are applied on panels S, Q and Y, respectively, to establish a proper seal when the panels of each form are folded at modified fold station 500 (FIG. 57). The forms may be accumulated in a convenience pack at 66 for subsequent processing, or if subsequent printing station 108 is to be utilized, they may be continuously advanced toward station 500. When accumulated, the forms are subsequently advanced through print station 68 wherein various indicia is selectively applied to the panels thereof, after which the continuous series of forms may be again accumulated at 78, as in earlier embodiments. The forms are thereafter subjected to the modified folding, sealing and bursting operations illustrated in FIG. 57, wherein trim strips 96 and 98 are removed at station 100, and the panels of each form are folded at lines 52, 54 and 504 (FIGS. 58 and 59) at station 500 as diagrammatically illustrated by rolls 501, 502 and 503.

As will be noted from the drawings, lines 46, 46 are disposed in corresponding registry, and adhesive stripe 26 on panel P is in contacting relationship with adhesive stripe 22 on panel R, effecting a seal therebetween with the fold line 504 of panels Q and Y disposed inwardly thereof. Adhesive stripes 506 and 508 on panels Q and Y, respectively, effect a seal at the opposite end of each folded form. Since trim strips 96 and 98 are removed prior to folding at station 500, side edges 58 and 60 (FIG. 59) of panel P and R, respectively, are adhesively secured at stripes 27, 23, wherein side edges 59 and 501 of panel Q and Y, respectively, are disposed inwardly thereof. It should, of course, be understood that side edges 61 and 63 are likewise adjustably secured at stripes 28, 24 wherein side edges 62 and 512 of panels Q and Y, respectively, are disposed inwardly thereof.

Rolls 502 and 503 diagrammatically illustrate a combination folder-sealer-burster, wherein the various forms are folded by lines 52, 54 and 504, pressure is applied to corresponding adhesive stripes 506/508, and 22/26, 23/27 and 24/28, and folded, sealed forms are severed from the series and released as individual items at 516 for distribution by the endless conveyor 516.

As particularly illustrated in FIGS. 58 and 60, intermediate panels Q and Y are adapted to the folded, sealed envelope at tear lines 44 and 518, each of which in combination with tear lines 42 and 45, define stub 114. As in previous embodiments, the envelope may be snapped open by grasping the notches 48, 49 (FIG. 60) or may be torn along line 42, 44, 45 and 518 without damage to the intermediate panels. In either case, stub 114 is removed from frame Q and Y at lines 44 and 518, after which the intermediate panel may be unfolded or separated at line 504.

Figure 61:
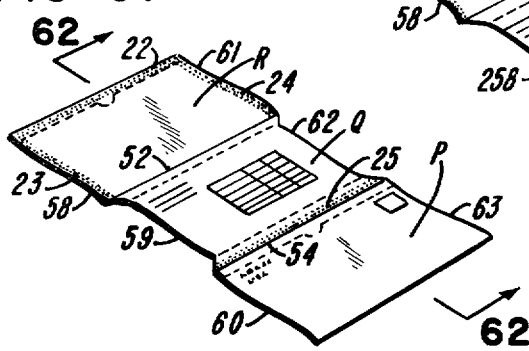
FIGS. 61 and 61A illustrate a plurality of single, independent forms incorporating the features of the present invention.
Figure 61A:
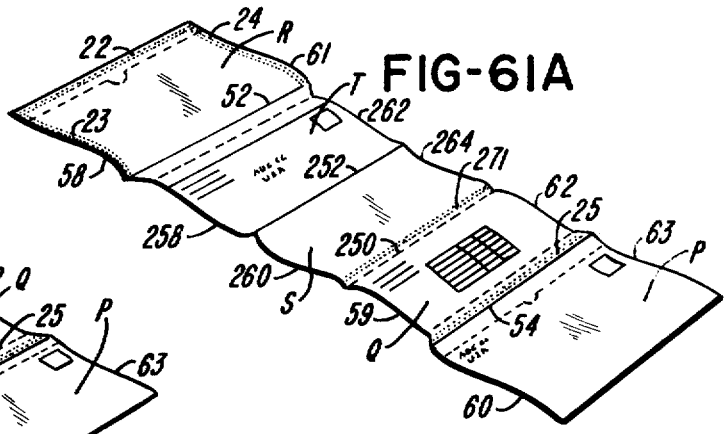
Figure 62:
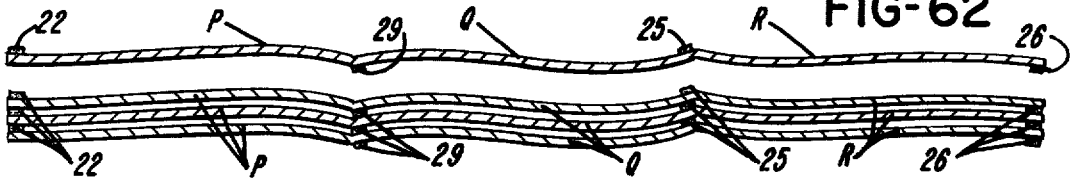
FIG. 62 is a sectional view taken at line 62—62 of FIG. 61.

FIGS. 61 and 61A each illustrate forms of the present invention irrespective of the method. The form of FIG. 61 is similar to the form of FIGS. 1–18, wherein envelope panels P and R are separated by a single, intermediate panel Q. Side edges 59 and 62 of panel Q are disposed inwardly of the corresponding side edges 58, 60 and 61, 63 of panels R and P, respectively. The form is adapted to be zig-zag folded at lines 52 and 54, to generate the envelope illustrated in FIGS. 9–15. The forms are readily stackable as illustrated in FIG. 62, wherein the various adhesive stripes are each similarly disposed, precluding premature contact thereof.

The form of FIG. 61A is similar to the form of FIGS. 33–48, wherein envelope panels P and R are separated by three intermediate panels Q, S and T and wherein panels S and T define an integral return envelope. When the form is zig-zag folded at lines 52, 252, 250, and 54, the mailing and return envelope including data panel Q, as illustrated in FIGS. 39–48, is generated. It should, of course, be understood that any of the forms of the present invention may be produced as separate, independent units and that said forms are stackable in a manner similar to that shown in FIG. 62.

Figure 63:
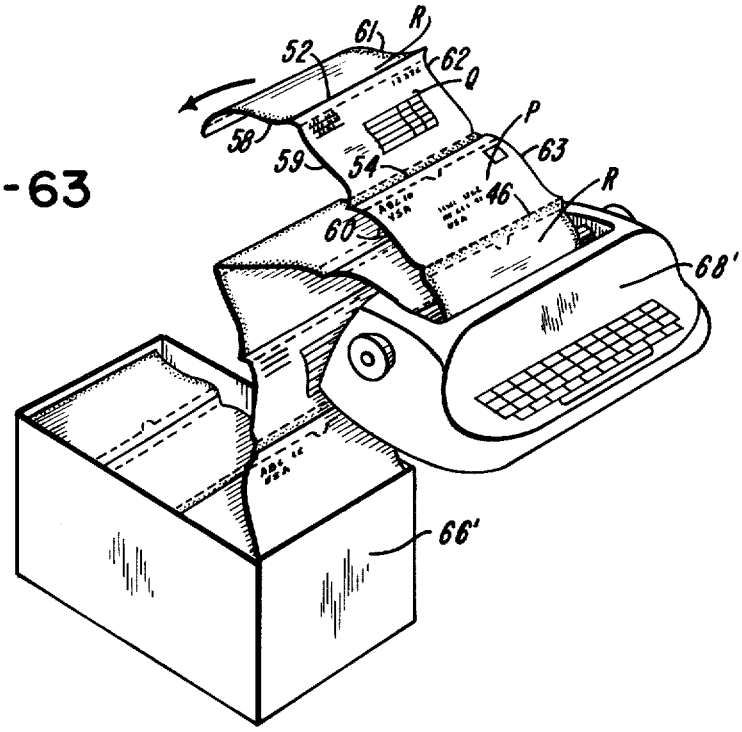
FIG. 63 illustrates a continuous series of end-interconnected forms incorporating the features of the present invention.

FIG. 63 illustrates a series of end-to-end interconnected forms similar to that shown in FIGS. 1–18 wherein the various trim-strips (96 and 98 in FIGS. 4 and 5) have been removed prior to accumulation in a convenience pack at 66'. The series is adapted to be subsequently advanced through the printing station such as, by way of example, office typewriter 68', wherein variable indicia is selectively applied to panels P and Q. The series of forms may then be sequentially folded as in FIG. 3, or each form may be severed from the series at line 46 and manually folded at lines 52 and 54 to generate the envelope illustrated in FIGS. 9–15. It should, of course, be understood that any of the forms of the present invention may be produced in a manner similar to that illustrated in FIG. 63. Further, it should be noted that stuffer-insert 88 may be incorporated in each of the forms of FIGS. 61–63 prior to sealing of the envelope.

From the foregoing, it can be seen that I have provided a single-ply, multi-panel envelope form defined by a pair of coplanar envelope-defining panels disposed in end-to-end, spaced relationship and at least one intermediate panel disposed between and in end-connected relationship with the envelope defining panels, wherein the opposite side edges of each intermediate panel are disposed inwardly of the corresponding side edges of the envelope-defining panels. The forms may include any number of intermediate panels, and the collective length thereof may be greater than the corresponding dimension of the final, resulting envelope. Where desired, an adjacent pair of intermediate panels may comprise the front and back panels of an integral return envelope.

The form is producible in an end-to-end interconnected series from a continuously advancing, endless web of sheet material which is transversely subdivided into a pair of end-to-end interconnected forms, each of which comprises a pair of coplanar end-adjacent envelope defining panels separated by an end-connected intermediate panel integral and coplanar therewith. A pair of opposed longitudinally extending corresponding side edges are delineated in each of said forms, wherein the sides of the intermediate panel are disposed inwardly of the corresponding side edges of the envelope-defining panels and interconnected therewith. The panels of the form are adapted to be sequentially zig-zag folded into sealed envelope-defining relationship, wherein the side edges of the envelope-defining panels are disposed in contact with and secured to one another and wherein the corresponding side edges of each intermediate panel are disposed inwardly from and free of connection with said sealed side edges. The intermediate panels may be removed from the interior of the envelope through access means provided in one marginal edge thereof.

The methods herein disclosed present the panels of each form in a manner permitting single pass printing of original indicia on what is both the interior and exterior surfaces of the final, resulting envelope and further provide for the insertion of stuffer-inserts in the interior of the envelope prior to sealing thereof. Where desired the forms and methods of the present invention may be modified for use in conjunction with imprint printing techniques. It should, of course, be understood that the various methods diagrammatically illustrated herein may be performed manually as well as with the aid of mechanical apparatus.

As used in the claims, the phrase interconnected stuffed mailing envelope assemblies refers to the structures, such as, by way of example, are illustrated in FIGS. 16, 18, 32, 46–48, 51–53, 58, 59, and 62, wherein the various intermediate panels of each of the various end-interconnected stuffed-envelope defining forms constitute and define the envelope stuffer, whether said intermediate panels be end-to-end interconnected as, by way of example, in FIGS. 4, 22, 49, 54, 60 and 61, wherein the outer-adjacent side edges of the various intermediate panels are free of adhesive and not interconnected; or as in FIGS. 36 and 38–40, wherein the side-edge-adjacent portions of adjoining pairs of the intermediate panels are interconnected for providing a return mailer envelope.

Likewise, the term insert refers to a separate item such as, by way of example, a sheet, photograph, article, or the like, such as, by way of example, is indicated by the numerals 88 in FIGS. 3, 35, and 46.

In other words, when an envelope has been fabricated from an envelope-defining form of the present invention, the resultant envelope will contain interconnected panels which singly or collectively constitute a "stuffer" for the envelope as ultimately defined when the envelope-defining panels of the form are secured around and in enclosing relationship with the intermediate panels.

What is claimed is:

1. As a new article of manufacture, a continuous series of end-interconnected stuffed-envelope-defining forms fabricated from a single, endless web, wherein each form comprises a series of five or more end-interconnected panels, the first and last of which define the front and rear panels of a mailer envelope, and the intermediate panels of which define an envelope stuffer, each envelope-defining panel having an outer transverse end-edge in connected relationship with an adjacent, outer transverse end-edge of the envelope-defining panel of an adjoining form, and an inner transverse edge which is disposed in connected relationship with an adjacent transverse end-edge of an adjoining intermediate panel; and wherein the transverse end to transverse end height of each intermediate panel is less than the distance between the inner and outer transverse end edges of each envelope-defining panel; transverse perforations adjacent and spaced from the inner transverse end edge of one of said envelope-defining panels, the interconnected transverse end edge of the adjoining intermediate panel, and the outer transverse end edge of the other of said envelope-defining panels, said perforations defining in each of said panels a stub and a line of tear along which said stub is removable from said panels; a removable tear-strip integral with, and extending along each side of the panels of a form, said strips having an inner edge which, when severed from the form, defines the overall side-to-side width of each panel thereof and wherein the overall width of each envelope-defining panel exceeds the overall width of each intermediate panel; adhesive along side-edge adjacent surfaces of the envelope-defining panels and along transverse end-edge adjacent surfaces of those envelope-defining and intermediate panels of the form which are disposed in abutting contact when the panels are disposed in zig-zag relationship for disposing the envelope-defining panels in overlying relationship and externally of the intermediate panels; said form being further characterized in that the side edges of the intermediate panels are spaced inwardly from and free of connection with the side edges of the envelope-defining panels and the transverse end edges of the intermediate panels are integral with and releasably connected to adjacent transverse end-edges of the envelope-defining panel; and wherein only the transverse end-edge of that intermediate panel which adjoins one of said envelope-defining panels is in registry with the outer transverse end-edge of the other envelope-defining panel of the form when the panels are disposed in zig-zag relationship.

2. An article of manufacture as called for in claim 1, wherein the adhesive is a self-stick adhesive adherent only to another surface having like self-stick adhesive thereon, and wherein those portions of the removable tear-strip immediately adjacent the side edges of the intermediate panels are disposed between the side edges of the envelope-defining panels to preclude the premature, accidental or unintentional contacting of the adhesive along the side-adjacent surfaces of the envelope-defining panels when the panels of a form are disposed in zig-zag relationship.

3. A one-piece, stuffed envelope assembly comprising a pair of outer, envelope-defining panels, and an odd number of at least three intermediate, stuffer-defining panels, wherein the side-to-side width of each intermediate panel is less than the side-to-side width of each envelope-defining panel, and wherein each of said envelope-defining panels include a free, outer transverse end-edge and an inner transverse end-edge which is disposed in connected relationship with an adjacent transverse end-edge of an adjoining intermediate panel, the transverse end to transverse end height of each intermediate panel being less than the distance between the inner and outer transverse end-edges of an envelope defining panel, said envelope-defining and intermediate panels being disposed in zig-zag relationship with the envelope-defining panels overlying and enclosing the intermediate panels, means interconnecting those portions of the side edges of the envelope-defining panels outwardly beyond the side edges of the intermediate panels, and means interconnecting the free, outer transverse end-edge adjacent surfaces of each envelope defining panel with the adjacent transverse end-edge surface of that intermediate panel which adjoins the other envelope-defining panel, wherein only the adjacent transverse end-edge of that intermediate panel which adjoins one of said envelope-defining panels is disposed in registry with the free, outer transverse end-edge of the other of said envelope-defining panels.

4. An envelope assembly as called for in claim 1, which includes an insert disposed between the adjacent surfaces of any two of the panels which collectively comprise the stuffed envelope assembly.

5. An envelope assembly as called for in claim 1, wherein a record-transfer panel is releasably secured to and carried by the outer surface of an envelope-defining panel.

6. An envelope assembly as called for in claim 5, wherein the rear surface of that envelope-defining panel which constitutes the top panel of a stuffed envelope assembly is provided with transfer material.

7. An envelope assembly as called for in claim 3, which includes transverse perforations adjacent and spaced inwardly from the free, outer transverse end-edge of one envelope-defining panel, the inner transverse end-edge of the other envelope-defining panel and the adjacent transverse end-edge of that intermediate panel which adjoins said other envelope-defining panel, defining a stub and a line of tear along which said stub is removed from said panels incident to opening the envelope and removing the intermediate panels therefrom, and other transverse perforations adjacent and spaced inwardly from the adjacent transverse end-edge of that intermediate panel which adjoins said one envelope-defining panel, defining a tear line along which the intermediate panels are severed from the envelope assembly incident to removal therefrom.

8. An envelope assembly as called for in claim 3, wherein each intermediate panel which adjoins an envelope-defining panel is of transverse end-to-transverse end height greater than that of each of the remaining intermediate panels.

9. An envelope assembly as called for in claim 3, wherein an adjacent pair of intermediate panels define the front and rear panels of a return envelope, and wherein adhesive is disposed along side-edge-adjacent surfaces of said return-envelope-defining panels, whereby said return envelope is closed on both side-edges and one transverse end-edge and is open along the remaining transverse end-edge.

10. An envelope assembly as called for in claim 9, wherein said return-envelope-defining panels are of different transverse end-to-transverse end height and wherein an extending poortion of the larger of said panels defines a flap for closing the open transverse end-edge of the return envelope.

11. A stuffed envelope assembly as called for in claim 3, wherein each individual assembly comprises one of a plurality of stuffed envelope assemblies each of which are initially disposed in end-to-end interconnected relationship along the said free, outer transverse end edges of the envelope-defining panels.

12. A one-piece, stuffed envelope assembly comprising a pair of outer, envelope-defining panels and an intermediate panel of a height equal to the height of said envelope-defining panels, wherein the side-to-side width of the intermediate panel is less than the side-to-side width of each envelope-defining panel, and wherein each of said envelope-defining panels includes a free, outer transverse end edge and an inner transverse end edge which is disposed in connected relationship with an adjacent transverse end edge of the intermediate panel, said envelope-defining and intermediate panels being disposed in zig-zag relationship with the envelope-defining panels overlying and enclosing the intermediate panel with the free, outer transverse end edge of each envelope-defining panel in registry with that transverse end-edge of the intermediate panel which is connected to the inner transverse end-edge of the other envelope-defining panel, means interconnecting said registered transverse end edges, and means interconnecting those portions of the side edges of the envelope-defining panels outwardly beyond the side edges of the intermediate panels, said intermediate panel including a transverse tear line intermediate its transverse end edges.

* * * * *